US010814509B2

(12) United States Patent
Takahashi et al.

(10) Patent No.: US 10,814,509 B2
(45) Date of Patent: Oct. 27, 2020

(54) CUTTING APPARATUS AND PRINTER

(71) Applicant: Brother Kogyo Kabushiki Kaisha, Nagoya-shi, Aichi-ken (JP)

(72) Inventors: Ryoya Takahashi, Gifu (JP); Hidenori Jo, Nagoya (JP); Masashi Iwamoto, Nagoya (JP); Misato Osuka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 226 days.

(21) Appl. No.: 16/038,778

(22) Filed: Jul. 18, 2018

(65) Prior Publication Data

US 2019/0022884 A1 Jan. 24, 2019

(30) Foreign Application Priority Data

Jul. 20, 2017 (JP) ..... 2017-141374

(51) Int. Cl.

| | |
|---|---|
| ***B41J 11/70*** | (2006.01) |
| ***B21D 1/08*** | (2006.01) |
| ***B26D 1/08*** | (2006.01) |
| ***B26D 1/00*** | (2006.01) |
| ***B41J 33/26*** | (2006.01) |

(Continued)

(52) U.S. Cl.

CPC ..... *B26D 1/085* (2013.01); *B26D 1/0006* (2013.01); *B41J 3/4075* (2013.01); *B41J 11/703* (2013.01); *B41J 11/706* (2013.01); *B41J 15/042* (2013.01); *B41J 33/26* (2013.01); *B26D 2001/006* (2013.01); *B26D 2001/0053* (2013.01)

(58) Field of Classification Search

CPC ..... B26D 1/085; B26D 1/0006; B26D 7/088; B26D 7/1818; B26D 2001/0053; B26D 2001/006; B26D 2007/1809; B41J 3/4075; B41J 11/703; B41J 11/706; B41J 15/042; B65H 35/008; B65H 35/0086; B65H 35/04; B65H 35/06; B65H 2301/515326

USPC ..... 400/621; 83/694

See application file for complete search history.

(56) References Cited

U.S. PATENT DOCUMENTS

| | | | |
|---|---|---|---|
| 8,602,670 | B2 | 12/2013 | Shirotori et al. |
| 8,834,048 | B2 | 9/2014 | Mochida et al. |
| 2008/0069623 | A1 | 3/2008 | Kobayashi et al. |

(Continued)

FOREIGN PATENT DOCUMENTS

| | | | |
|---|---|---|---|
| EP | 1900535 | A2 | 3/2008 |
| JP | 2004-148442 | A | 5/2004 |

(Continued)

*Primary Examiner* — Leslie J Evanisko

(74) *Attorney, Agent, or Firm* — Banner & Witcoff, Ltd.

(57) ABSTRACT

The disclosure discloses a cutting apparatus including a feeder, a fixed blade, a movable blade, and at least one scraping-off device. The movable blade is configured to slide in a sliding direction crossing a transport direction against the fixed blade and is configured to move along the sliding direction from a standby position on one side to a cutting position on the other side and to cut the print-receiving medium fed by the feeder. The at least one scraping-off device is disposed in proximity to the movable blade and is configured to come into contact from the other side with an adhesive that has adhered to the movable blade and scrape off the adhesive when the movable blade moves from the standby position on the one side to the cutting position on the other side.

14 Claims, 25 Drawing Sheets

(51) Int. Cl.
*B41J 3/407* (2006.01)
*B41J 15/04* (2006.01)

(56) References Cited

U.S. PATENT DOCUMENTS

| | | | | |
|---|---|---|---|---|
| 2008/0202302 | A1* | 8/2008 | Hayashi | B26D 7/025<br>83/256 |
| 2010/0086340 | A1 | 4/2010 | Takami | |
| 2010/0221056 | A1 | 9/2010 | Shirotori et al. | |
| 2010/0329768 | A1* | 12/2010 | Watanabe | B26D 7/1818<br>400/621 |
| 2012/0027495 | A1 | 2/2012 | Mochida et al. | |
| 2019/0023517 | A1* | 1/2019 | Iwamoto | B41J 11/66 |

FOREIGN PATENT DOCUMENTS

| | | | | |
|---|---|---|---|---|
| JP | 2010-089215 | A | | 4/2010 |
| JP | 2010-201533 | A | | 9/2010 |
| JP | 2012-030445 | A | | 2/2012 |
| JP | 2017144544 | A | * | 8/2017 |

* cited by examiner

COMPARATIVE EXAMPLE

FIG. 25

| θ \ L3 | 2mm | 3mm | 4mm | 5mm | 6mm | 7mm | 8mm |
|---|---|---|---|---|---|---|---|
| 5° | × | × | × | × | × | × | × |
| 15° | × | △ | ○ | ○ | △ | × | × |
| 25° | × | ○ | ○ | ○ | ○ | × | × |
| 35° | × | × | ○ | ○ | ○ | × | × |
| 45° | × | × | × | × | × | × | × |

CUTTING APPARATUS AND PRINTER

CROSS-REFERENCE TO RELATED APPLICATION

The present application claims priority from Japanese Patent Application No. 2017-141374, which was filed on Jul. 20, 2017, the disclosure of which is incorporated herein by reference in its entirety.

BACKGROUND

Field

The present disclosure relates to a cutting apparatus cutting a print-receiving medium including an adhesive layer, and a printer including the cutting apparatus.

Description of the Related Art

A printer (tape printer) is known that includes a cutting apparatus (cutter unit) cutting a print-receiving medium (roll sheet) including an adhesive layer. The cutting apparatus of the printer according to this prior art has multiple tapered through-holes disposed in a movable blade and a fixed blade. When the movable blade cuts the print-receiving medium including the adhesive layer, an adhesive adhering to the movable blade is dropped into the through-holes of the movable blade and the fixed blade for removal and reduction.

However, the cutting apparatus of the prior art must have the multiple tapered through-holes previously formed in the movable blade and the fixed blade, which increases the manufacturing cost.

SUMMARY

An object of the present disclosure is to provide a cutting apparatus and a printer using the same capable of reducing an adhesive adhering to a movable blade during cutting of a print-receiving medium without causing an increase in manufacturing cost.

In order to achieve the above-described object, according to the aspect of the present application, there is provided a cutting apparatus comprising a feeder configured to feed a print-receiving medium including an adhesive layer along a predetermined transport direction, a fixed blade having a shape like a flat plate, a movable blade that has a shape like a flat plate and is configured to slide in a sliding direction crossing the transport direction against the fixed blade and is configured to move along the sliding direction from a standby position on one side to a cutting position on the other side and to cut the print-receiving medium fed by the feeder, and at least one scraping-off device that is disposed in proximity to the movable blade and is configured to come into contact from the other side with an adhesive that has adhered to the movable blade and scrape off the adhesive when the movable blade moves from the standby position on the one side to the cutting position on the other side.

The cutting apparatus of the present disclosure is provided with the fixed blade and the movable blade sliding against the fixed blade. The fed print-receiving medium is cut by the movable blade moving from the standby position on one side to the cutting position on the other side and sliding against the fixed blade. In this case, the print-receiving medium has the adhesive layer, and the adhesive layer exposed on a cut surface during the cutting adheres to the movable blade. Consequently, this leads to a significant increase in amount of the adhesive adhering to the movable blade as the cutting operation is repeated.

Therefore, in the present disclosure, at least one scraping-off device is disposed in proximity to the movable blade separately from the movable blade and the fixed blade. Thus, when the movable blade moves from one side to the other side, the adhesive having adhered to the movable blade is brought into contact with the at least one scraping-off device and scraped off, so that the adhesive adhering to the movable blade can be reduced by a simple and inexpensive configuration without disposing multiple tapered through-holes in the fixed blade and the movable blade as in the conventional case.

BRIEF DESCRIPTION OF THE DRAWINGS

FIG. 25 is a table showing quality of discharge performance of the print label from a discharging exit in the case that L3 and θ are varied.

DETAILED DESCRIPTION OF THE PREFERRED EMBODIMENTS

An embodiment of the present disclosure will now be described with reference to the drawings.

<General Structure of Label Producing Apparatus>

First, an appearance general structure of a label producing apparatus 1 of this embodiment will be described with reference to FIGS. 1 to 3. In the following description, the up-down direction, the front-rear direction, and the left-right direction correspond to the directions of arrows shown as appropriate in FIG. 1 etc.

Figure 1:
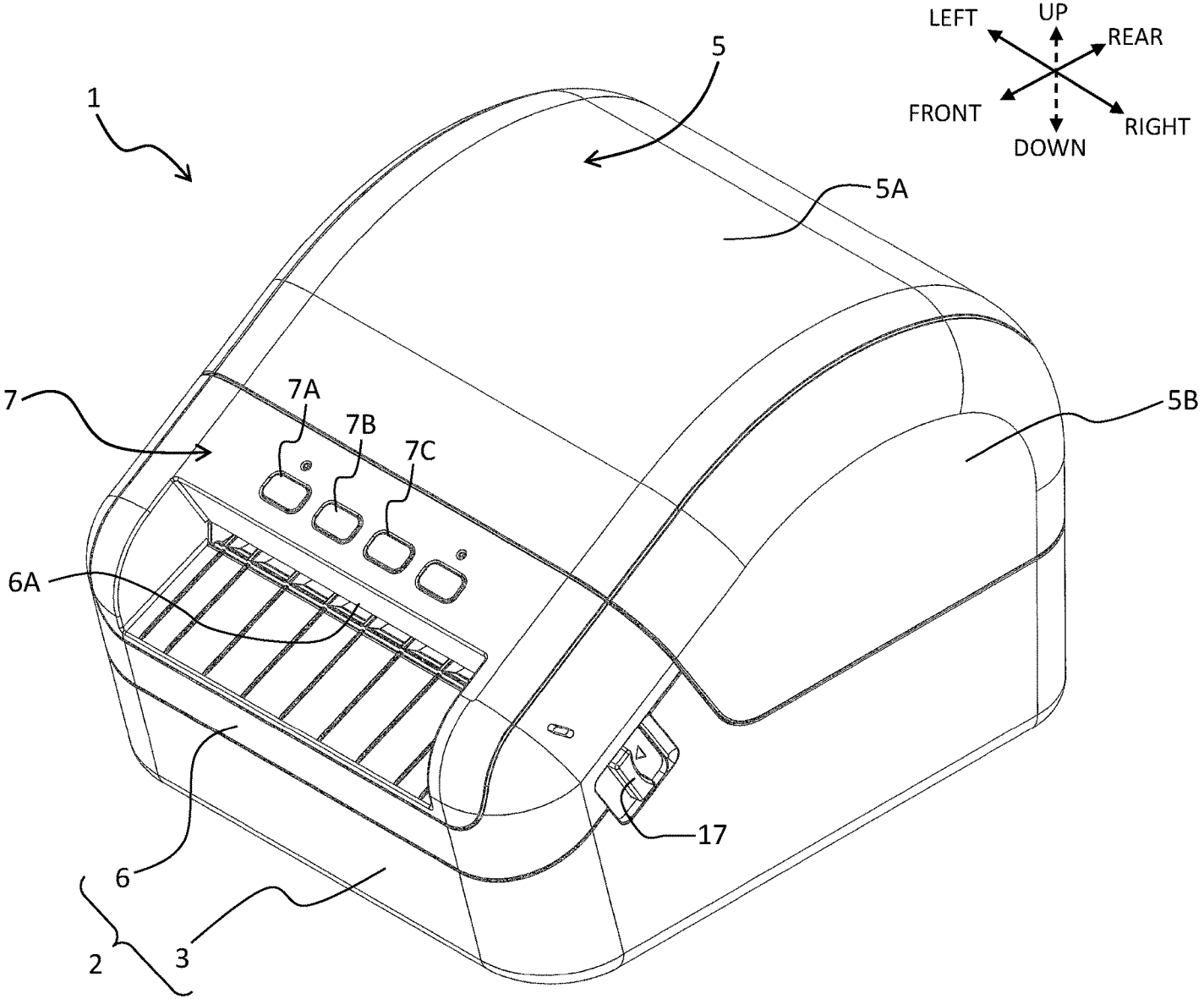
FIG. 1 is a perspective view of a label producing apparatus of an embodiment of the present disclosure as viewed from the front upper right.
Figure 2:
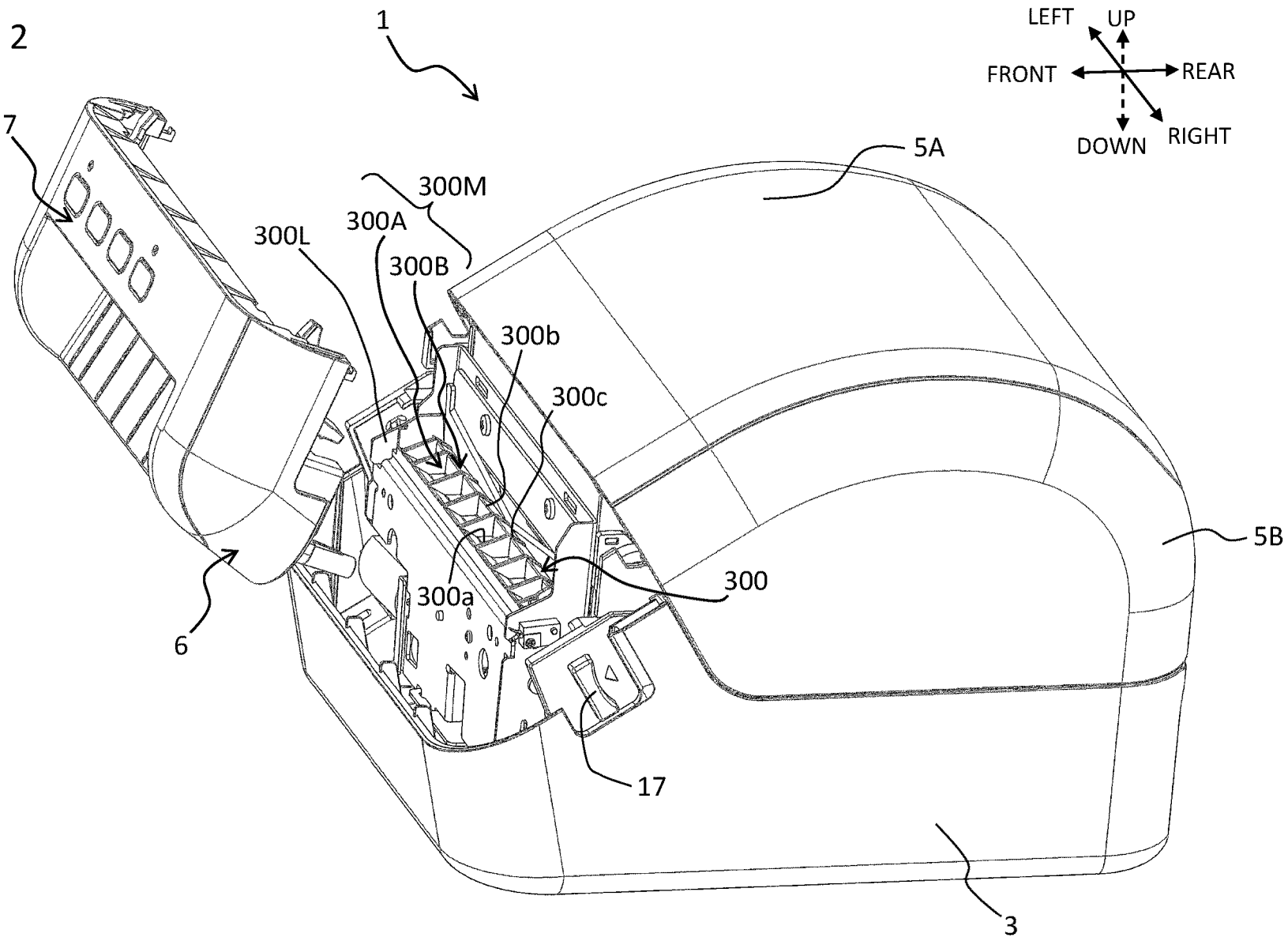
FIG. 2 is an exploded perspective view showing a state with a front panel removed to show an internal structure as viewed from the front upper right.

In FIG. 1, a label producing apparatus 1 has a housing 2 and an upper cover 5. The housing 2 and the upper cover 5 are made of resin, for example.

The housing 2 includes a housing main body 3 and a front panel 6 disposed on a front upper portion of the housing main body 3.

A side wall of the housing main body 3 is provided with a release knob 17 manually operated to the front side by a user to release locking of the upper cover 5 to the housing 2 to make the upper cover 5 openable. A rear wall of the housing main body 3 is provided with an inlet 9 and USB ports 11A, 11B.

The front panel 6 is provided with a discharging exit 6A discharging a print-receiving tape with print (described later) from the inside to the outside of the housing 2. An operation part 7 is disposed on a front upper surface of the front panel 6 and includes buttons such as a power button 7A, a feed button 7B for discharging the print-receiving tape by a predetermined length, and a cutter button 7C causing a cutter unit (described later) to cut the print-receiving tape.

The upper cover 5 includes a roll cover 5A and a side cover 5B attached to the roll cover 5A. The roll cover 5A is pivotally connected at a rear end portion to the housing 2, so that the upper cover 5 has an openable/closable structure with respect to the housing 2.

<Internal Structure of Label Producing Apparatus>

Figure 4:
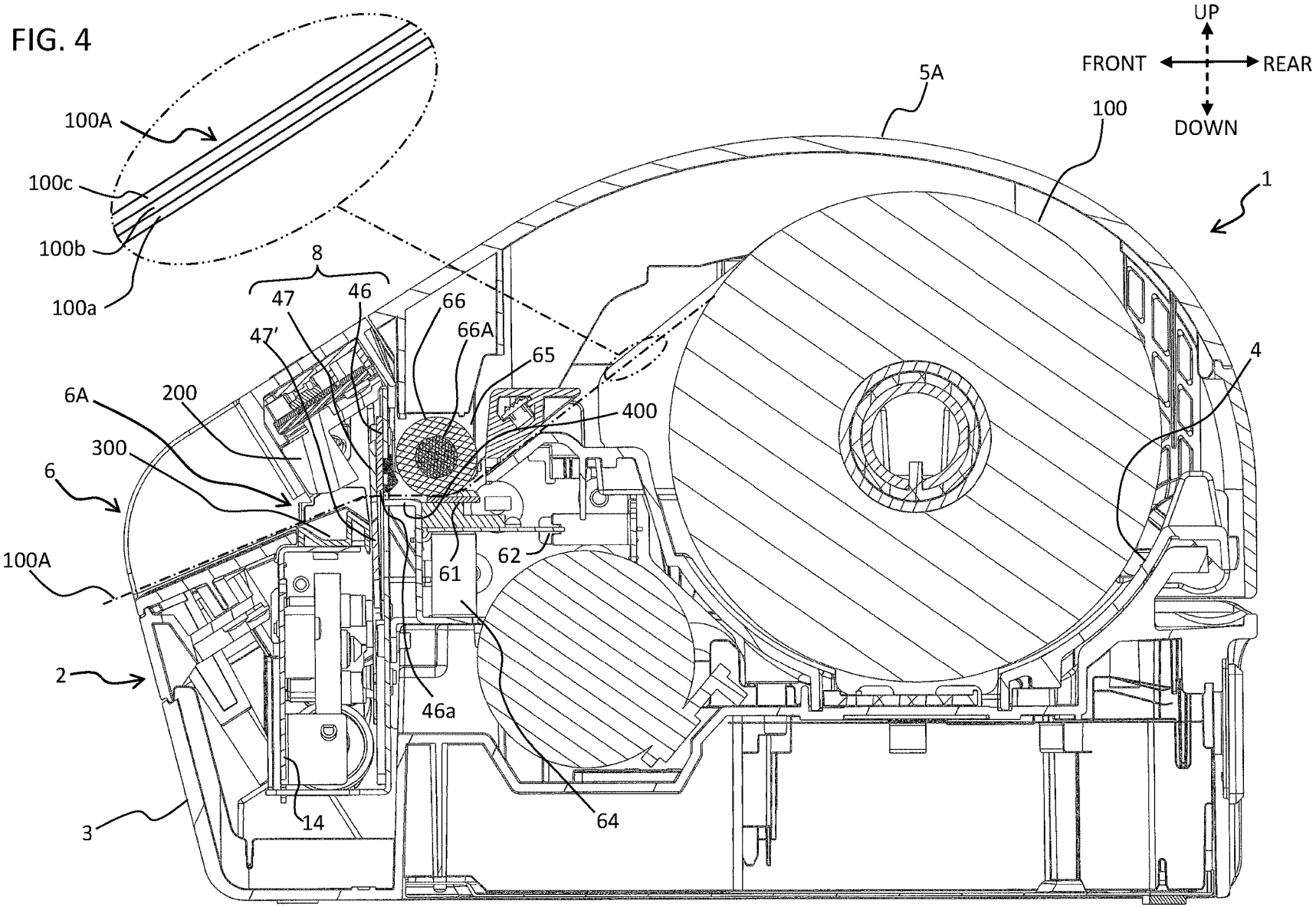
FIG. 4 is a side sectional view showing the internal structure of the label producing apparatus.

An internal structure of the label producing apparatus 1 will be described with reference to FIG. 4. In FIG. 4, the label producing apparatus 1 has a concave roll storage part 4 on the rear side of an internal space of the housing 2. This roll storage part 4 stores a roll 100 of a wound print-receiving tape 100A having a predetermined width such that the print-receiving tape 100A is fed out from the upper side of the roll.

A roller shaft 66A of a platen roller 66 is rotatably supported by a bracket 65 disposed to both axial ends on the lower side of a front end portion of the roll cover 5A. The platen roller 66 feeds the print-receiving tape 100A fed out from the roll 100 stored in the roll storage part 4. A gear (not shown) driving the platen roller 66 is fixed to one shaft end of the roller shaft 66A.

As shown in an enlarged view of FIG. 4, the print-receiving tape 100A has a three-layer structure in which a thermal paper 100*a*, an adhesive layer 100*b*, and a separation sheet 100*c* are laminated. The thermal paper 100*a* is an elongated self-coloring tape. A front surface (a lower surface in the enlarged view of FIG. 4) of the thermal paper 100*a* is a print surface. The adhesive layer 100*b* is a layer of an adhesive formed on a back surface (an upper surface in the enlarged view of FIG. 4) of the thermal paper 100*a*. The separation sheet 100*c* is an elongated tape affixed to the adhesive layer 100*b* and is peelable from the adhesive layer 100*b*. The print-receiving tape 100A as described above is referred to as a "non-fixed length label".

A print-receiving tape also usable in the label producing apparatus 1 other than the "non-fixed length label" described above is a "die-cut label" having multiple pieces of thermal paper preliminarily cut into a predetermined shape and affixed to a separation sheet by an adhesive layer.

This roll 100 is configured as the print-receiving tape 100A wound into a roll shape such that the print surface of the thermal paper 100*a* faces radially inward. Consequently, the print-receiving tape 100A is fed out from the upper side of the roll 100 with the print surface of the thermal paper 100*a* facing downward and is printed by a printing head 61 arranged on the lower side of the print-receiving tape 100A.

The printing head 61 is pivotally supported at an intermediate portion thereof and is fixed to one end of a support member 62 urged upward by a spring member 64. In the figure, a dashed-dotted line indicates a transport path of the print-receiving tape 100A fed out from the roll 100 and fed for receiving a print formed by the printing head 61.

The attachment position of the platen roller 66 in the upper cover 5 corresponds to a position at which the printing head 61 is disposed in the housing 2, and when the upper cover 5 is closed, an urging force of the spring member 64 causes the printing head 61 to press and urge the print-receiving tape 100A to the platen roller 66. Consequently, the print-receiving tape 100A is sandwiched by the platen roller 66 disposed on the upper cover 5 and the printing head 61 disposed on the housing 2 so that a print can be formed by the printing head 61. When the upper cover 5 is closed, the gear of the platen roller 66 meshes with a gear train not shown on the housing 2 side, so that the platen roller 66 can rotationally be driven by a platen-roller motor (not shown) including a stepping motor etc. to feed the print-receiving tape 100A. On the other hand, when the upper cover 5 is opened by the release knob 17, the printing head 61 is separated from the platen roller 66.

A cutter unit 8 is disposed on the downstream side in the transport direction of the printing head 61. The cutter unit 8 includes a fixed blade 46, and a movable blade 47 (see also FIGS. 5, 6, 8, etc. described later) arranged to face the front side of the fixed blade 46 (in other words, on the downstream side in the transport direction).

An upper guide part 200 and a lower guide part 300 are disposed on the front side of the cutter unit 8 (in other words, on the downstream side in the transport direction). The upper guide part 200 is disposed on a lower portion of the front panel 6, and the lower guide part 300 is disposed on a front-side portion of the housing main body 3. The print-receiving tape 100A having a print formed thereon passes through between the upper guide part 200 and the lower guide part 300 and is fed to the discharging exit 6A while being guided by the guide parts.

<Detailed Structure of Upper Guide Part>

A detailed structure of the upper guide part 200 will be described with reference to FIG. 3. In FIG. 3, the upper guide part 200 includes a substantially rectangular parallelepiped box body having an upper end fixed on the back surface side of the front panel 6. The upper guide part 200 has a flat plate-like rear wall part 201 extending in the left-right direction on the rear side (in other words, on the upstream side in the transport direction, or on the upper side in the state shown in FIG. 3). The upper guide part 200 has at least a portion (in this example, the whole) of the inside of the box body partitioned into multiple spaces U in the left-right direction (in other words, the longitudinal direction of the rectangular parallelepiped) by multiple partition walls 200*a* each extending in the front-rear direction and arranged in the left-right direction. The rear ends of the multiple partition walls 200*a* are connected to the rear wall part 201. The multiple spaces U are each divided into a small space Ua on the rear side (in other words, on the upstream side in the transport direction) and a small space Ub on the front side (in other words, on the downstream side in the transport direction) by a partition wall 200*b* extending in the left-right direction.

<Detailed Structure of Lower Guide Part>

A detailed structure of the lower guide part 300 will be described with reference to FIGS. 5A to 5G and FIG. 2. In FIGS. 5A to 5G and FIG. 2, the lower guide part 300 includes a main body part 300M having a lower end fixed to a substantially L-shaped plate 14 (see FIG. 4) disposed on a front-side portion of the housing main body 3, and a left-side wall part 300L and a right-side wall part 300R disposed on both end portions in the left and right direction of the main body portion 300M. The main body part 300M includes a front region 300A located on the front side and a rear region 300B located on the rear side. A partition wall 300*b* extending in the left-right direction is disposed on a boundary between the front region 300A and the rear region 300B.

Figure 11:
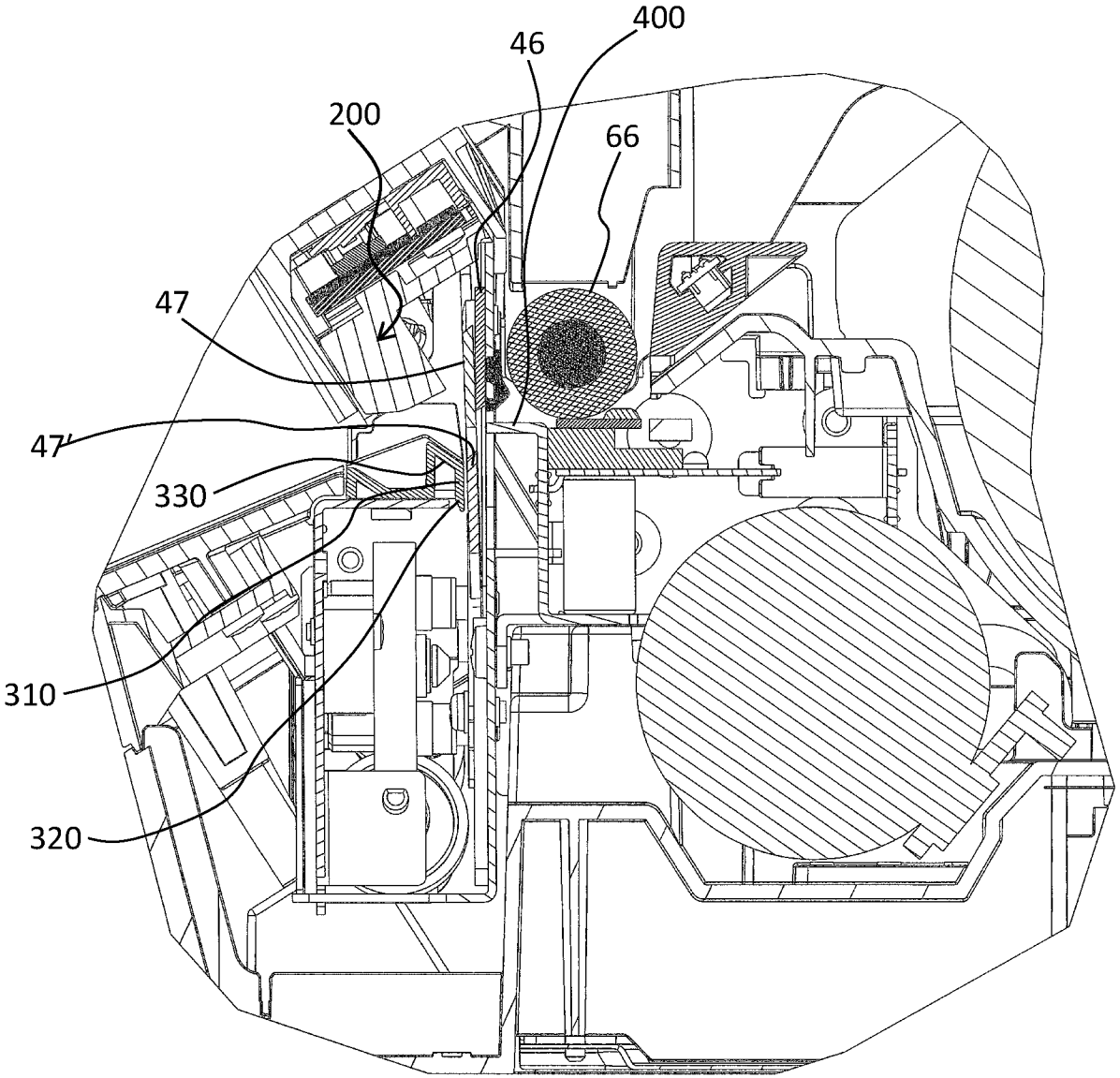
FIG. 11 is a main-part extraction side sectional view showing the structure shown in FIG. 10.

The front region 300A is configured in a form of a substantially rectangular parallelepiped box body, and at least a portion (in this example, the whole) of the inside of the box body is partitioned into multiple spaces D in the left-right direction (in other words, the longitudinal direction of the rectangular parallelepiped) by multiple partition walls 300*a* each extending in the front-rear direction and arranged in the left-right direction. An upper end portion of each of the partition walls 300*a* is inclined downward from the rear side toward the front side (see FIGS. 11, 24, etc. described later).

The rear region 300B is provided with multiple ribs 300*c* each extending in the front-rear direction and arranged in the left-right direction and has flat plate-like portions 300*d* between the adjacent ribs 300*c*, 300*c*. The ribs 300*c* and the flat plate-like portions 300*d* are inclined upward from the rear side toward the front side (see also FIGS. 11, 24, etc. described later).

<Detailed Structure of Cutter Unit>

Figure 6:
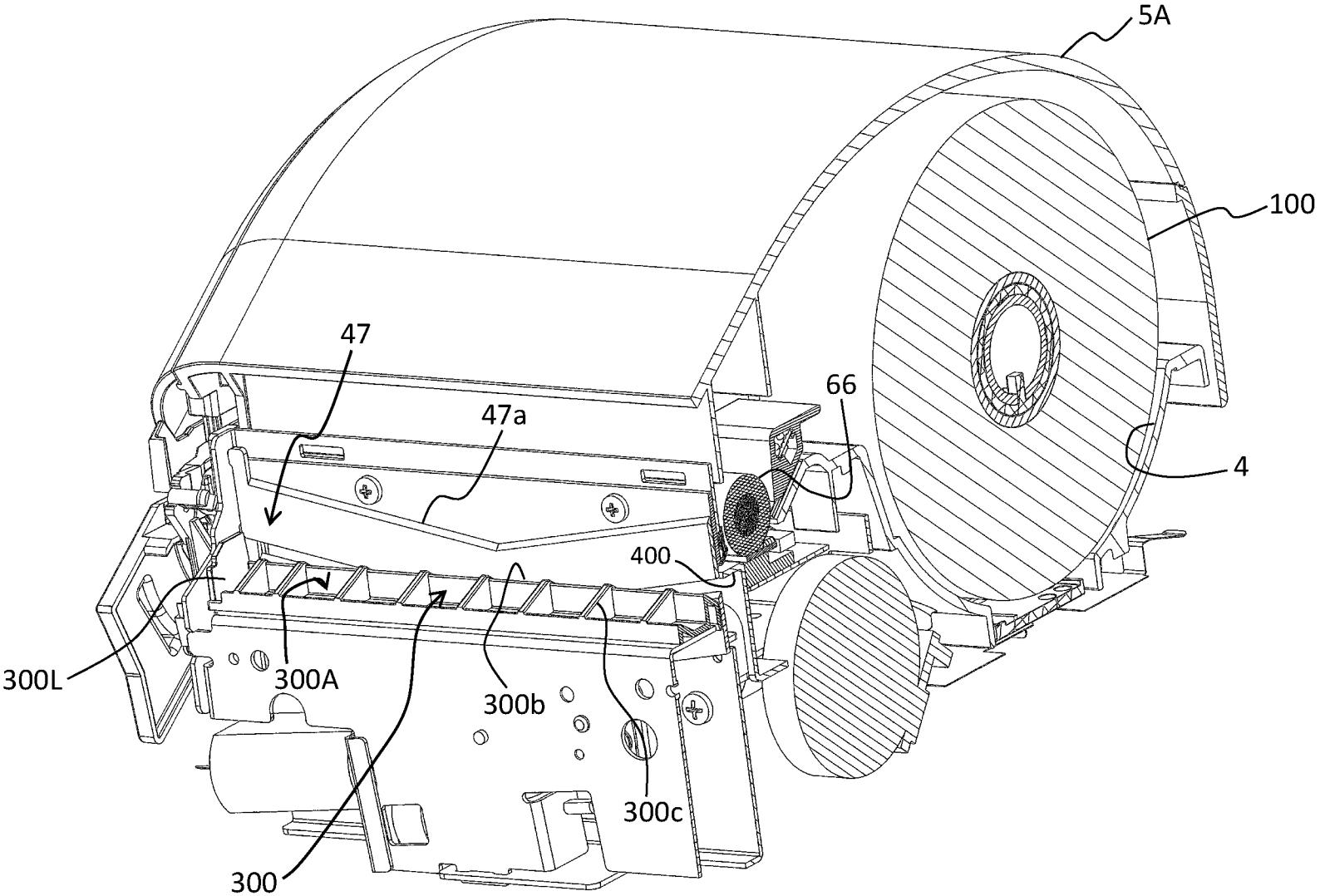
FIG. 6 is a main-part extraction perspective view of the internal structure of the label producing apparatus shown in FIG. 4.
Figure 7A:
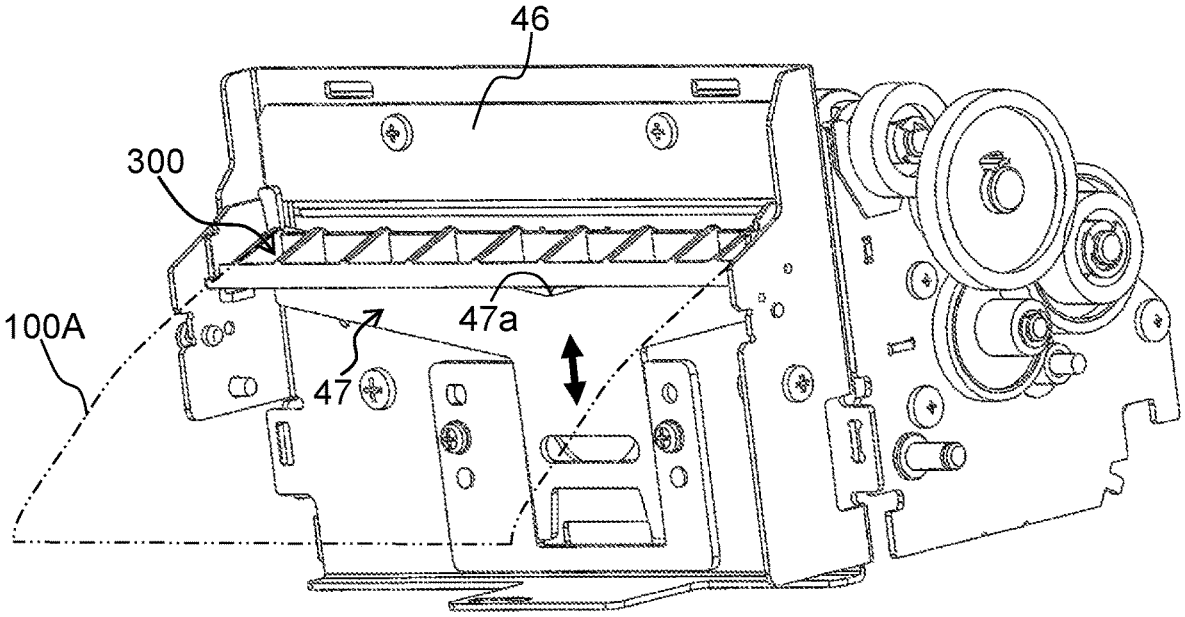
FIG. 7A is a perspective view from the front right showing a state in which a movable blade is at a standby position among a fixed blade, the movable blade, an upper guide part, and a peripheral structure thereof shown in FIG. 6.
Figure 7B:
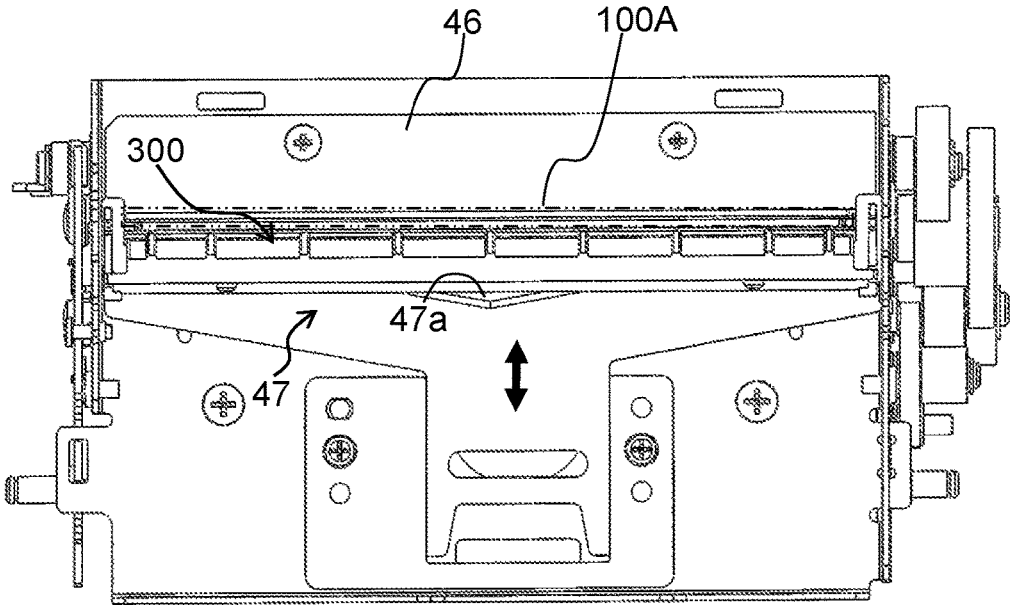
FIG. 7B is a front view from the front right showing a state in which the movable blade is at the standby position among the fixed blade, the movable blade, the upper guide part, and the peripheral structure thereof shown in FIG. 6.

A detailed structure of the cutter unit 8 will be described with reference to FIGS. 6, 7, and 8. In FIGS. 6, 7, and 8, the cutter unit 8 includes the fixed blade 46 and the movable blade 47 as described above.

The fixed blade 46 has a flat plate shape and includes a blade edge 46*a* at a lower end (see also FIG. 4). The blade edge 46*a* extends substantially horizontally in the left-right direction.

The movable blade 47 has a flat plate shape and includes a substantially V-shaped blade edge 47*a* at an upper end in a front view (in other words, when viewed in the transport direction of the print-receiving tape 100A). The movable blade 47 is arranged to be made slidable by a cutting motor (not shown) in a cutting direction (from below to above in FIG. 4) crossing (in this example, substantially orthogonal to) the transport direction of the print-receiving tape 100A with respect to the fixed blade 46. Specifically, the movable blade 47 is movable along the sliding direction from a standby position (see FIGS. 7A and 7B) on one side (in this example, the lower side) along the sliding direction to a cutting position (see FIGS. 8A and 8B) on the other side (in this example, the upper side) along the sliding direction and moves from the standby position to the cutting position to cut the print-receiving tape 100A in the width direction (left-right direction) in cooperation with the fixed blade 46. In FIG. 4, the movable blade (denoted by "47" in FIG. 4) located at the cutting position and the movable blade (denoted by "47'" in FIG. 4) located at the standby position are shown together for convenience (the same applies to FIGS. 10, 11, 12, 13, and 24 described later).

<General Operation of Label Producing Apparatus>

When the upper cover 5 is closed and, subsequently, the platen roller 66 is rotationally driven by the platen motor in the label producing apparatus 1 configured as described above, the print-receiving tape 100A is pulled. As a result, the print-receiving tape 100A is fed out from the roll 100. The print-receiving tape 100A fed out from the roll 100 is fed through the transport path to a contact position between the platen roller 66 and the printing head 61. At this point, the printing head 61 is driven and controlled to form a print on the print surface of the thermal paper 100*a* of the print-receiving tape 100A. Subsequently, the print-receiving tape 100A having the print formed on the thermal paper 100*a* passes through between the upper guide part 200 disposed on the lower portion of the front panel 6 and the lower guide part 300 disposed on the housing main body 3 and is discharged from the discharging exit 6A onto the front panel 6 while being guided by the guide parts. When the print-receiving tape 100A is extended outward by a predetermined length from the cutter unit 8, the user operates the cutter button 7C, and the print-receiving tape 100A is cut by the cutter unit 8. The user peels off the separation sheet 100*c* of the cut print-receiving tape 100A and uses the printed heat-sensitive paper 100*a* as a print label to be affixed to an object (an article etc.).

<Behavior of Adhesive Layer in Cutter Unit>

Figure 9A:
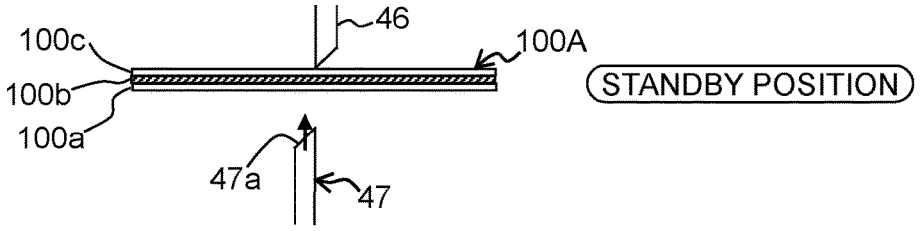
FIG. 9A is an explanatory view showing a print-receiving tape cutting behavior in a comparative example in which a scraping-off mechanism for an adhesive is not provided.
Figure 9B:
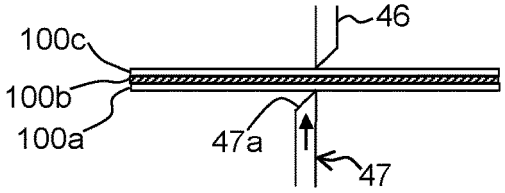
FIG. 9B is an explanatory view showing the print-receiving tape cutting behavior in the comparative example in which a scraping-off mechanism for an adhesive is not provided.
Figure 9C:
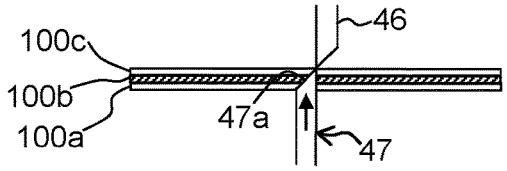
FIG. 9C is an explanatory view showing the print-receiving tape cutting behavior in the comparative example in which a scraping-off mechanism for an adhesive is not provided.
Figure 9D:
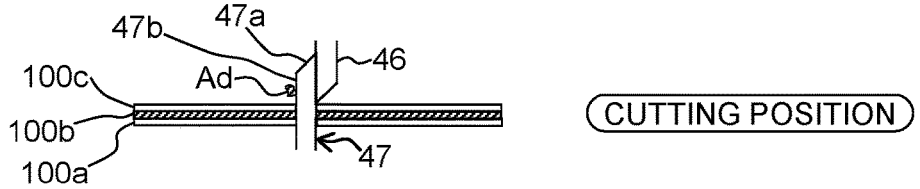
FIG. 9D is an explanatory view showing the print-receiving tape cutting behavior in the comparative example in which a scraping-off mechanism for an adhesive is not provided.
Figure 9E:
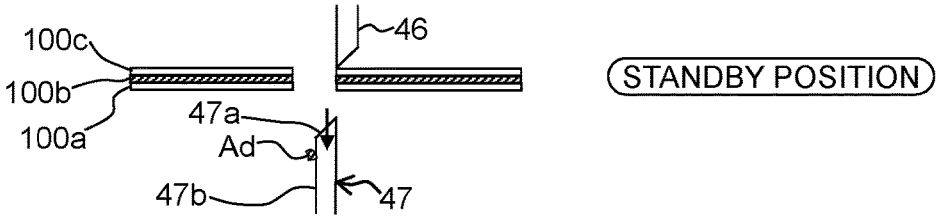
FIG. 9E is an explanatory view showing the print-receiving tape cutting behavior in the comparative example in which a scraping-off mechanism for an adhesive is not provided.
Figure 9F:
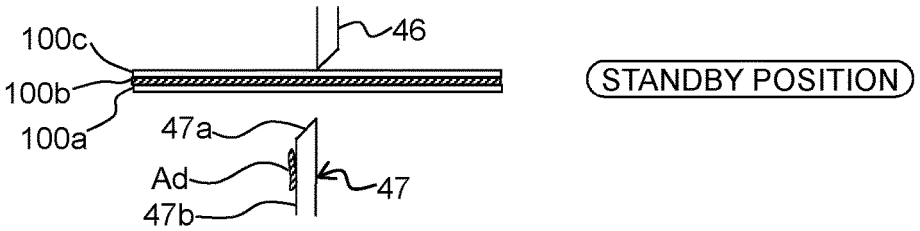
FIG. 9F is an explanatory view showing the print-receiving tape cutting behavior in the comparative example in which a scraping-off mechanism for an adhesive is not provided.
Figure 10:
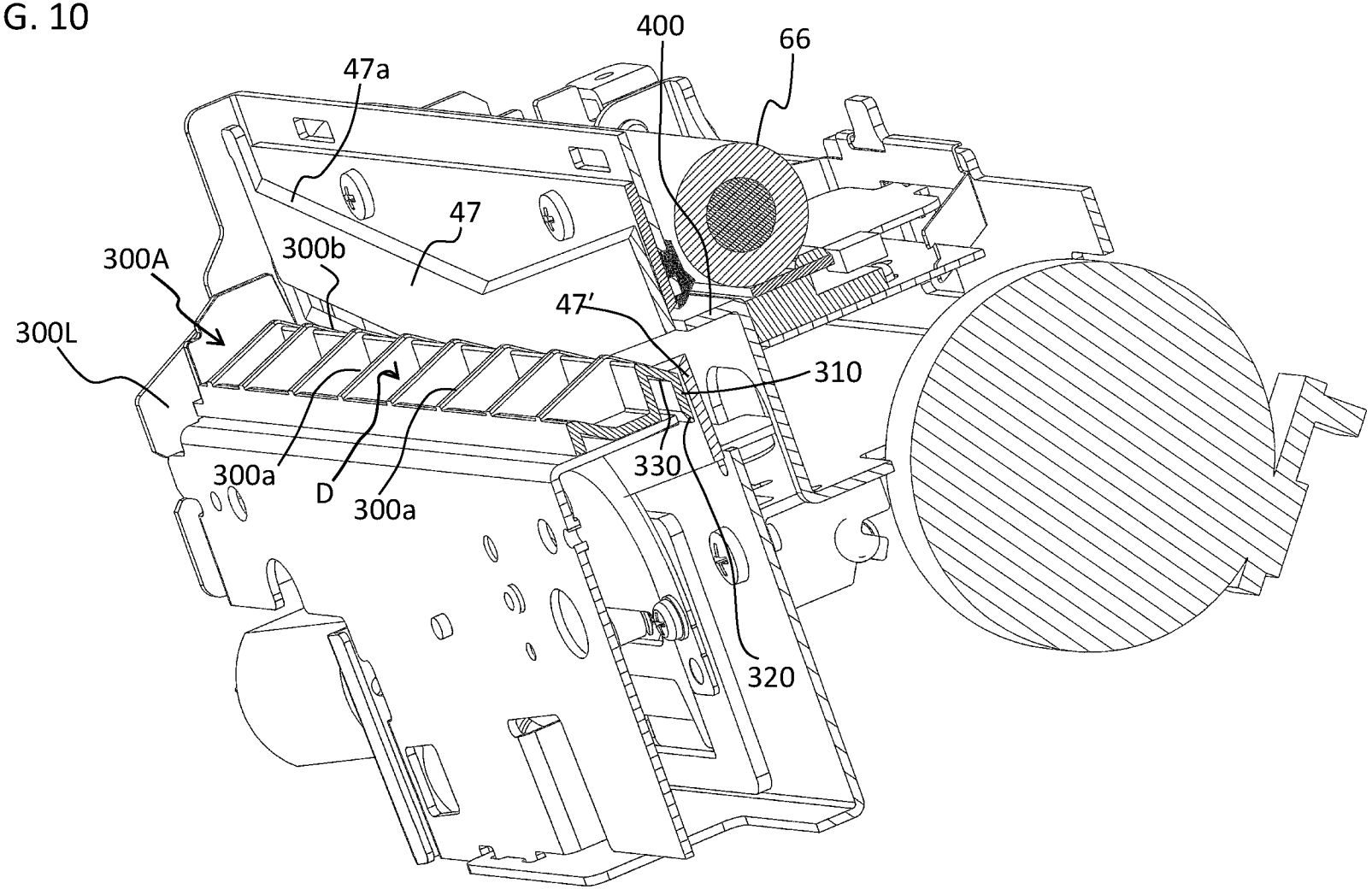
FIG. 10 is a main-part extraction perspective view of the structure shown in FIG. 6, showing a detailed structure of a scraping-off mechanism included in the embodiment of the present disclosure.

As described above, in the operation, the movable blade 47 moves from the standby position on the lower side to the cutting position on the upper side and slides against the fixed blade 46 in the cutter unit 8, and the print-receiving tape 100A is thereby cut. In this case, as described above, the print-receiving tape 100A has the thermal paper 100*a*, the adhesive layer 100*b*, and the separation sheet 100*c* laminated in this order from the lower side to the upper side. Therefore, when ascending from the standby position shown in FIG. 9A and cutting into the print-receiving tape 100A as shown in FIG. 9B, the movable blade 47 cuts the thermal paper 100*a*, the adhesive layer 100*b*, and the separation sheet 100*c* in this order. In this regard, since the movable blade 47 comes into contact with the adhesive layer 100*b* exposed on a cut surface (see FIG. 9C), the cutting is completed while a portion of the adhesive thereof is adhering to a side surface 47*b* on the front side of the movable blade 47 (see the cutting position shown in FIG. 9D). Consequently, even when returning again to the standby position after the cutting, the movable blade 47 has the adhering adhesive remaining on the side surface 47*b* (see FIG. 9E). Therefore, as the movable blade 47 repeats the operation of cutting the print-receiving tape 100A, the adhesive having adhered to the movable blade 47 continues to accumulate, and the amount of adhesion significantly increases (see FIG. 9F). In FIGS. 9D to 9F, the adhesive having adhered to the movable blade 47 is represented by a small lump, which is referred to as an adhesive Ad.

<Scraping Off of Adhesive Layer>

In this embodiment, regarding the above description, a mechanism scraping off the adhesive adhering to the movable blade 47 is disposed as a first feature. The details thereof will hereinafter be described.

<Scraping-Off Mechanism Disposed on Front Side of Movable Blade>

In this embodiment, a mechanism scraping off the adhesive having adhered to the movable blade 47 is first disposed on the front side relative to the movable blade 47 (in other words, on the downstream side in the transport direction), or specifically, on the lower guide part 300, for example. This scraping-off mechanism of the lower guide part 300 will be described with reference to FIGS. 10, 11, 12, and 13.

Figure 5A:
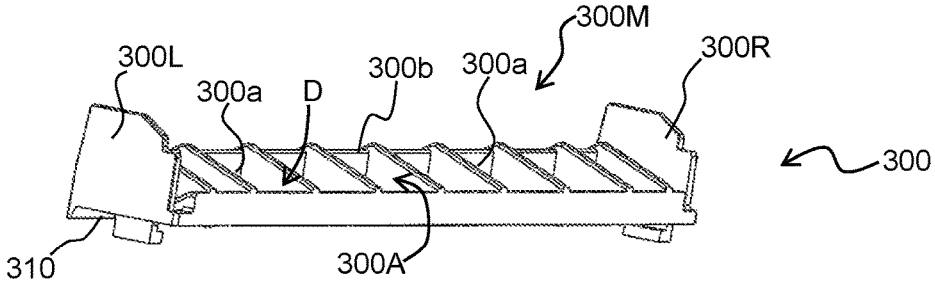
FIG. 5A is a perspective view from the front left showing a detailed structure of a lower guide part.
Figure 5B:
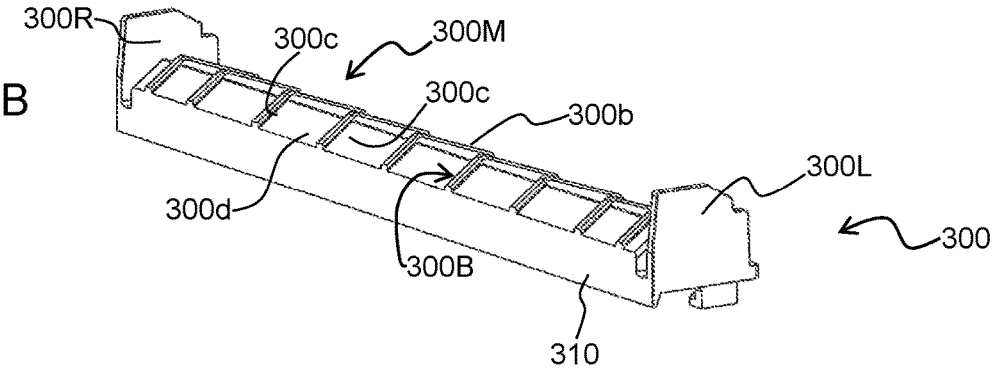
FIG. 5B is a perspective view from the rear left showing the detailed structure of the lower guide part.
Figure 5C:
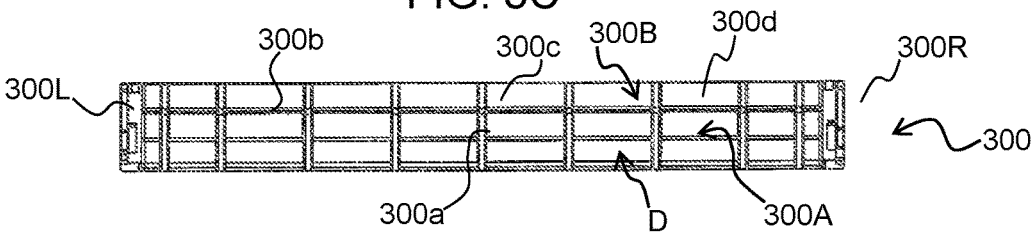
FIG. 5C is a top view showing the detailed structure of the lower guide part.
Figure 5E:
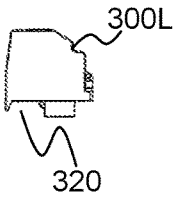
FIG. 5E is a left side view showing the detailed structure of the lower guide part.
Figure 5D:
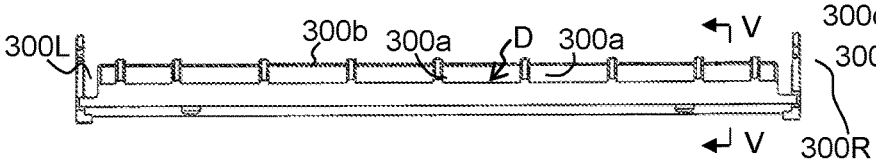
FIG. 5D is a front view from the front showing the detailed structure of the lower guide part.

As shown in FIGS. 10 to 13 and FIGS. 5A to 5G, a substantially flat plate-like extension part 310 is disposed to hang down and extend in a substantially vertical direction from the rear-side end portions of the ribs 300*c* of the lower guide part 300 (see also FIGS. 5A to 5G). In this case, the extension part 310 is arranged to face the movable blade 47 on the front side of the movable blade 47 (in other words, on the downstream side in the transport direction). As shown in FIG. 5B, the extension part 310 has a rectangular shape elongated in the left-right direction (in other words, the orthogonal direction orthogonal to the sliding direction of the movable blade 47) when viewed from the transport direction.

Figure 13:
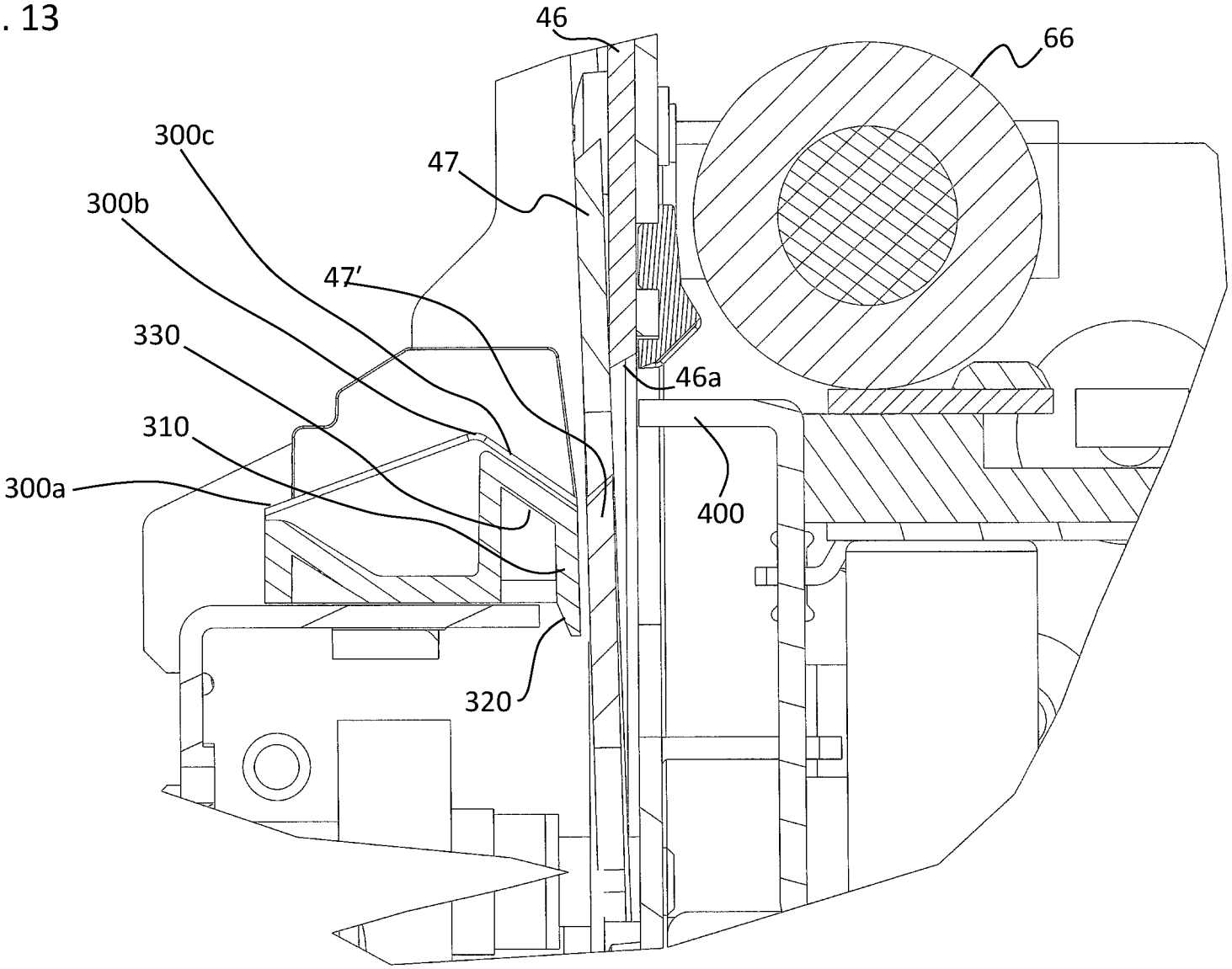
FIG. 13 is a partially enlarged view of the structure shown in FIG. 12.

The lower guide part 300 has a slope part 320 formed on an end portion (a lower end portion in this example) on the one side (the lower side in this example) of the extension part 310. As shown in FIG. 13, the slope part 320 is generally inclined toward the movable blade 47 as the side surface on the front side (in other words, on the downstream side in the transport direction) of the extension part 310 extends downward (see also FIG. 24 described later). In this case, as described above with reference to FIG. 4 etc., the lower guide part 300 also functions as a guide part positioned below the transport path of the print-receiving tape 100A to guide the feeding of the print-receiving tape 100A.

Additionally, on the front side relative to the extension part 310 of the lower guide part 300 (in other words, on the downstream side in the transport direction), an accumulating part 330 is disposed as a space opened downward for introducing upward from below and accumulating an adhesive scraped off as described later.

An adhesive scraping-off and accumulating behavior by the extension part 310, the slope part 320, and the accumulating part 330 will be described with reference to FIGS. 14A to 14F. As in FIGS. 9A to 9F, FIG. 14A shows a state in which the adhesive Ad (having adhered during the previous cutting operation) remains on the side surface 47*b* of the movable blade 47 when the movable blade 47 is returned to the standby position after cutting the print-receiving tape 100A.

Figure 14A:
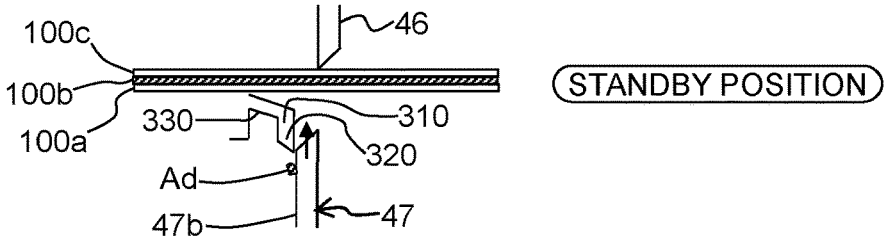
FIG. 14A is an explanatory view showing a print-receiving tape cutting behavior and an adhesive scraping-off/accumulating behavior in the embodiment of the present disclosure.
Figure 14B:
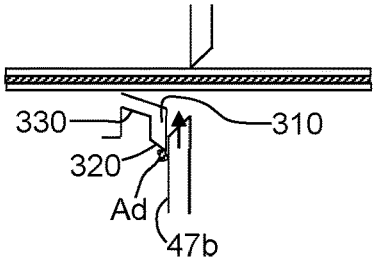
FIG. 14B is an explanatory view showing the print-receiving tape cutting behavior and the adhesive scraping-off/accumulating behavior in the embodiment of the present disclosure.
Figure 14C:
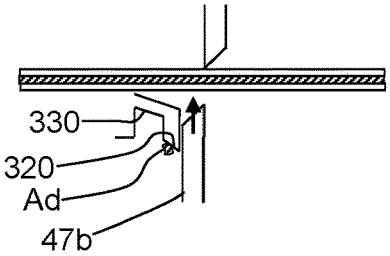
FIG. 14C is an explanatory view showing the print-receiving tape cutting behavior and the adhesive scraping-off/accumulating behavior in the embodiment of the present disclosure.

From this state, when the movable blade 47 moves upward toward the cutting position to newly cut the print-receiving tape 100A, a lower end portion of the extension part 310 comes into contact with the adhesive Ad having adhered to the side surface 47*b* (see FIG. 14B). Subsequently, when the movable blade 47 further moves upward, as shown in FIG. 14C, the adhesive Ad is scooped by the lower end portion of the extension part 310 and scraped off from the side surface 47*b* of the movable blade 47.

Figure 14D:
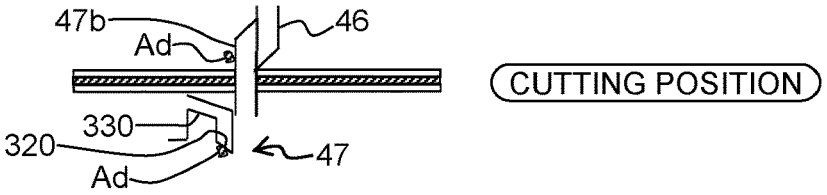
FIG. 14D is an explanatory view showing the print-receiving tape cutting behavior and the adhesive scraping-off/accumulating behavior in the embodiment of the present disclosure.

After the adhesive Ad is scraped off as described above, the movable blade 47 subsequently comes into contact with the adhesive layer 100*b* of the print-receiving tape 100A to be cut at the time of cutting as described above, so that a new adhesive Ad adheres to the side surface 47*b* of the movable blade 47 (see FIG. 14D). Subsequently, the movable blade 47 descends along with the new adhesive Ad having adhered hereto and returns to the standby position (see FIG. 14E).

Subsequently, when the blade ascends again to cut the new print-receiving tape 100A, the adhesive Ad is scraped off by the lower end portion of the extension part 310 through the same behavior shown in FIGS. 14A to 14C. In this way, each time the cutting operation of the movable blade 47 is repeated, the adhesive Ad scooped by the lower end portion of the extension part 310 sequentially accumulates at the lower end portion of the extension part 310, gradually pushing up the already scooped adhesive Ad. Therefore, the accumulated adhesive Ad gradually moves upward from the lower end portion of the extension part 310 along the slope part 320 and the front side surface of the extension part 310 (see FIG. 14F). In this way, the adhesive Ad moved upward is introduced into the accumulating part 330. Consequently, as the cutting operation of the movable blade 47 is repeated, the adhesive Ad is accumulated in the accumulating part 330, while the adhesive Ad does not cumulatively adhere to the side surface 47*b* of the movable blade 47.

<Scraping-Off Mechanism Disposed on Rear Side of Movable Blade>

In this embodiment, a mechanism scraping off the adhesive having adhered to the movable blade 47 is also disposed on the rear side relative to the movable blade 47 (in other words, the upstream side in the transport direction). Therefore, as shown in FIGS. 4, 5, 6, 10, 11, 12, 13, etc., a substantially horizontally-extending scraping-off plate 400 is disposed under the platen roller 66 in proximity to the upstream side of the blade edge 46*a* located at the lower end of the fixed blade 46. For example, when the movable blade 47 moves from the standby position on the lower side to the cutting position on the upper side, the adhesive of the adhesive layer 100*b* exposed on the cut surface of the print-receiving tape 100A may adhere to the rear side of the movable blade 47 (in other words, on the upstream side in the transport direction) as described above. Although not shown in detail, the scraping-off plate 400 has a function of, when the movable blade 47 with the adhesive having adhered to the rear side moves from the standby position to the cutting position as described above, coming into contact with and scraping off the adhering adhesive from the upper side and the rear side (in other words, the side of the fixed blade 46).

As shown in FIG. 4, the scraping-off plate 400 is located below the transport path of the print-receiving tape 100A and also functions as a guiding part guiding the feeding of the print-receiving tape 100A, similarly to the lower guide part 300.

Figure 8A:
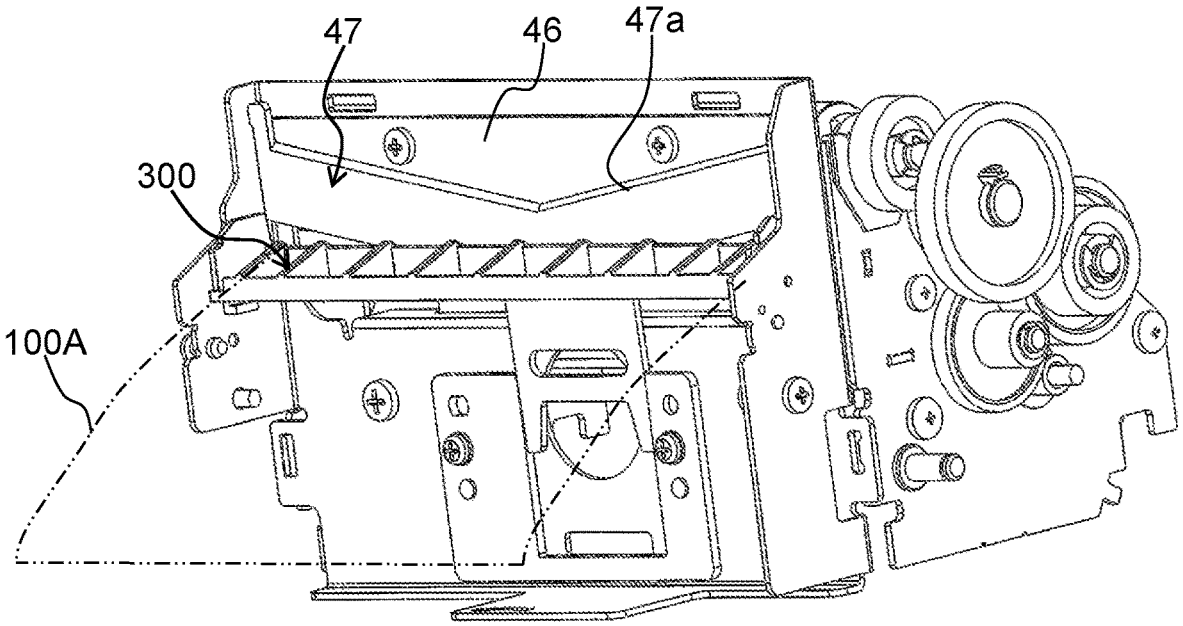
FIG. 8A is a perspective view from the front right showing a state in which the movable blade is at a cutting position among the fixed blade, the movable blade, the upper guide part, and the peripheral structure thereof shown in FIG. 6.
Figure 8B:
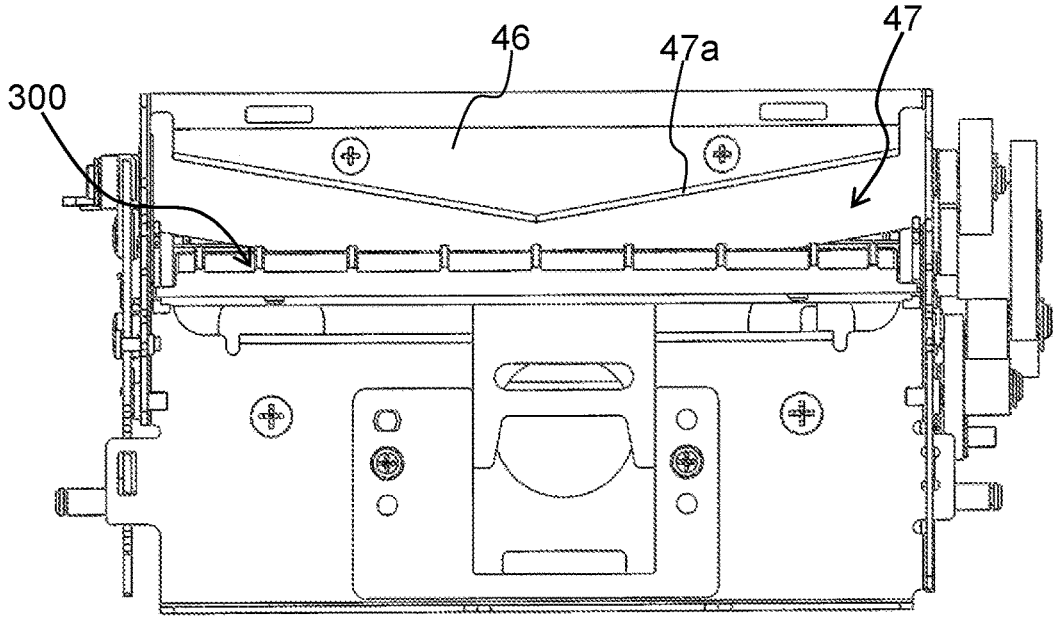
FIG. 8B is a front view from the front showing a state in which the movable blade is at the cutting position among the fixed blade, the movable blade, the upper guide part, and the peripheral structure thereof shown in FIG. 6.
Figure 12:
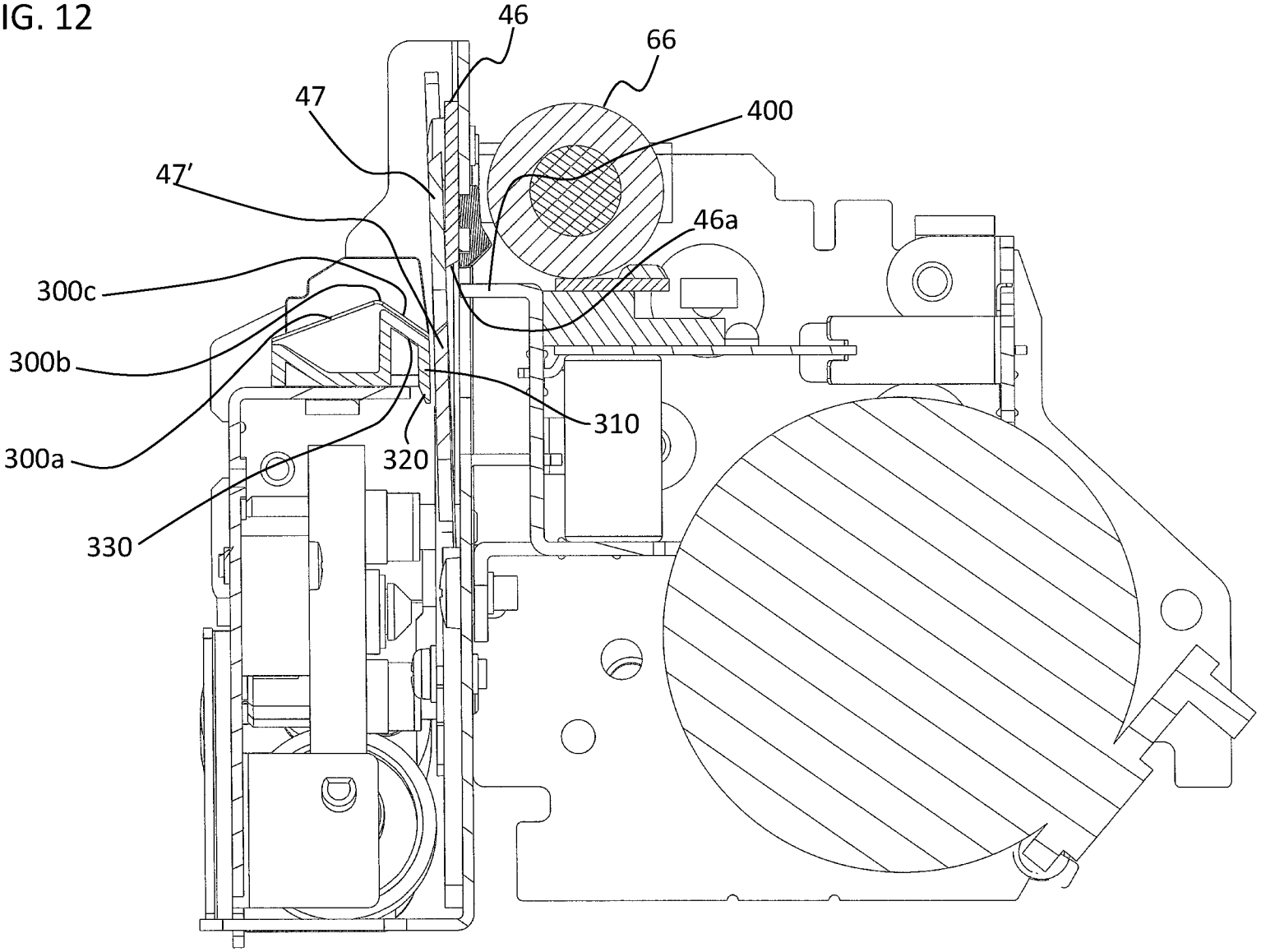
FIG. 12 is a partially enlarged view of the structure shown in FIG. 11.
Figure 17:
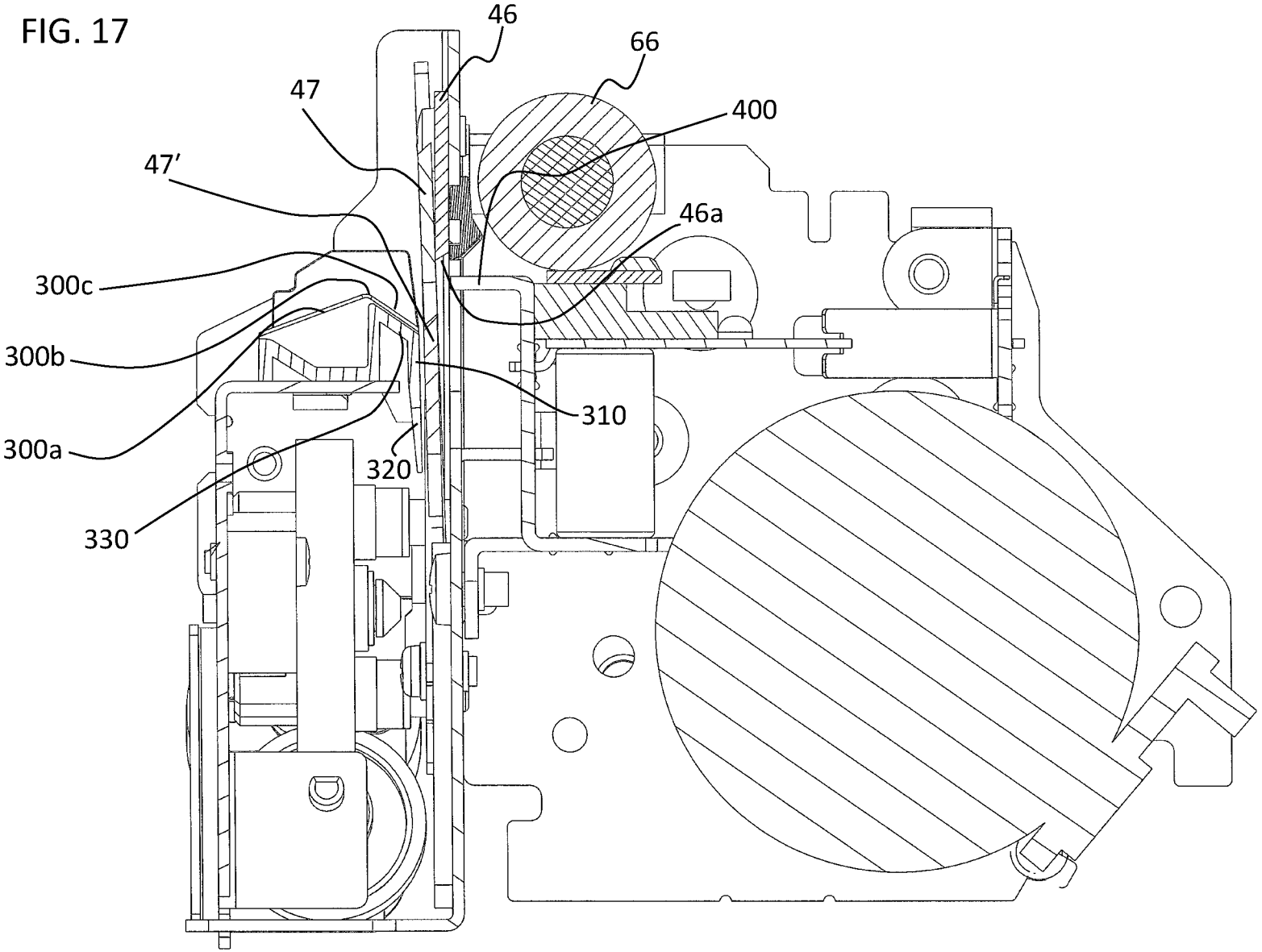
FIG. 17 is a side sectional view of the structure shown in FIGS. 16A and 16B.
Figure 18:
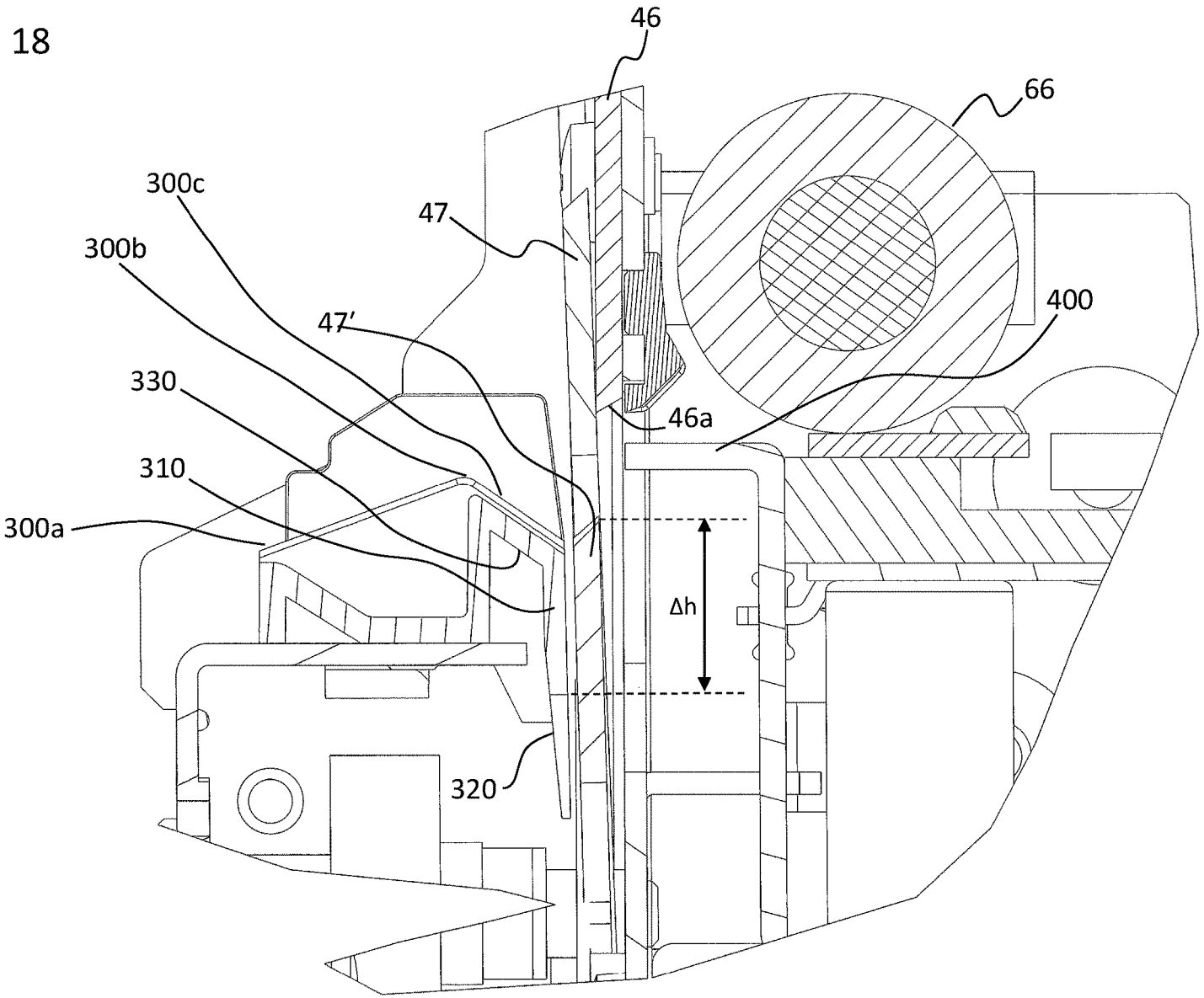
FIG. 18 is a partially enlarged view of the structure shown in FIG. 17.

Instead of disposing the rectangular extension part 310 elongated in the left-right direction as shown in FIGS. 5A to 5G, a substantially inverted-triangular extension part 310 may be disposed to the lower guiding part 300 in a front view (in other words, when viewed in the transport direction of the print-receiving tape 100A) as shown in FIGS. 15A to 15G respectively corresponding to FIGS. 5A to 5G, FIGS. 16A and 16B respectively corresponding to FIGS. 8A and 8A, FIG. 17 corresponding to FIG. 12, and FIG. 18 corresponding to FIG. 13. A slope part 320 is formed on a lower end portion of the substantially inverted-triangular extension part 310 (see FIGS. 15, 16, etc.). The shape of the lower end portion of the extension part 310 in the front view is substantially the same as the shape of the upper end portion of the movable blade 47 (i.e., the V shape of the blade edge 47*a*). In this case, when the movable blade 47 is at the standby position, the position of the lower end portion of the extension part 310 is lower than the position of the upper end portion of the movable blade 47 by a predetermined height (indicated by Δh in FIG. 18). The reason will be described later. Even in this configuration, the extension part 310 and the slope part 320 fulfill the same function as described above.

<Behavior During Discharge of Print-Receiving Tape>

Figure 19:
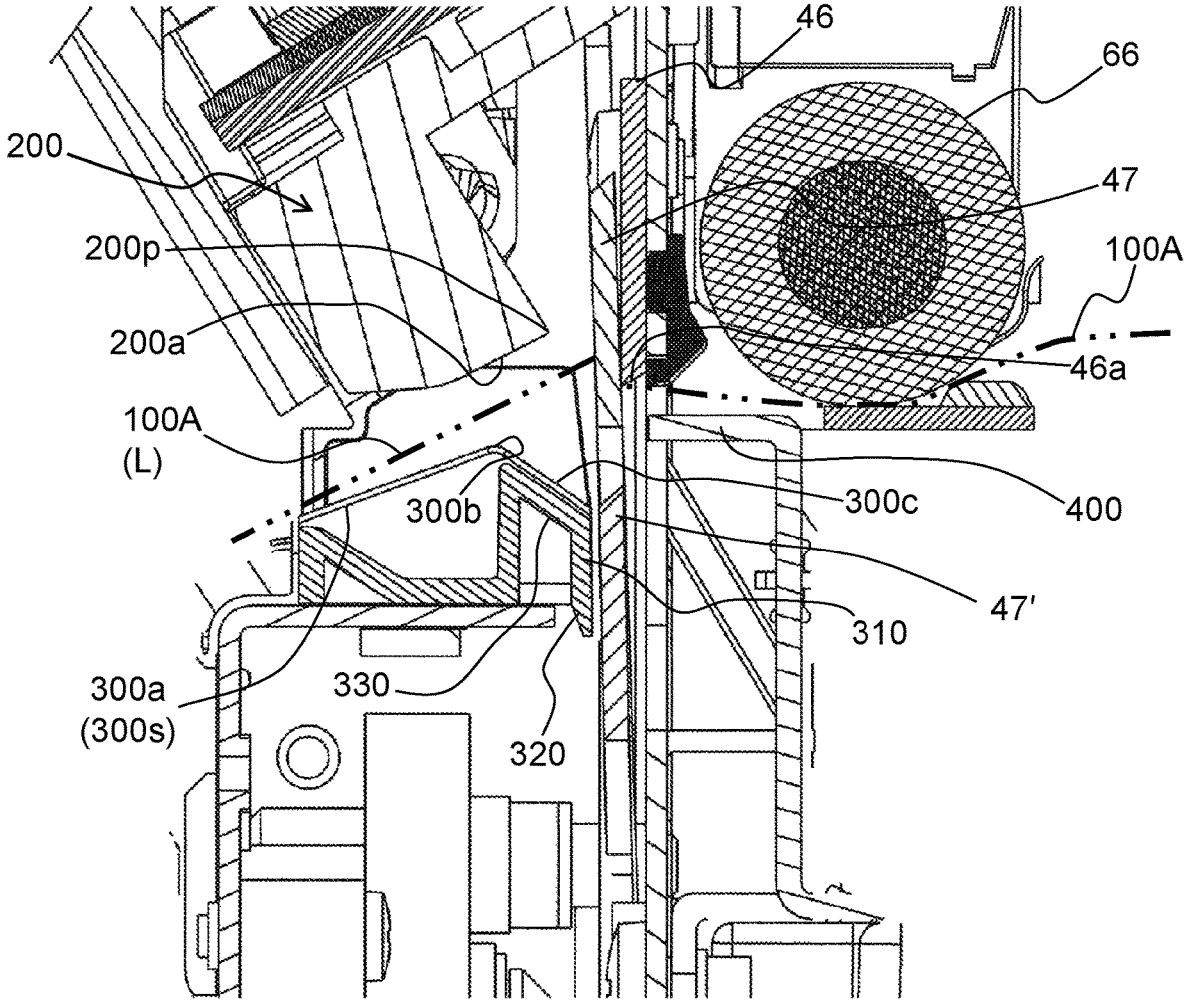
FIG. 19 is a schematic view showing a behavior of a print label after cutting of the print-receiving tape associated with ascent of the movable blade in the embodiment of the present disclosure.

On the other hand, the print-receiving tape 100A described above usually has a certain degree of rigidity (so-called stiffness). Since the blade edge 47*a* of the movable blade 47 is substantially V-shaped as described above, the blade edge 47*a* first starts cutting in the print-receiving tape 100A on both sides in the left-right direction and then gradually cuts through toward the center in the left-right direction, instead of cutting the entire area of the print-receiving tape 100A in the left-right direction at a time. Therefore, after the start of the cutting, the print-receiving tape 100A has a portion on the front side relative to the movable blade 47 and a portion on the rear side relative to the movable blade 47 partially connected to each other until the cutting is completely finished. Thus, as schematically shown in FIG. 19, the print-receiving tape 100A cut by the movable blade 47 is first lifted at an end portion on the rear side (in other words, the upstream side in the transport direction) as the movable blade 47 ascends. The print-receiving tape 100A will hereinafter be referred to as a "print label L". The same applies to the figures.

Figure 20:
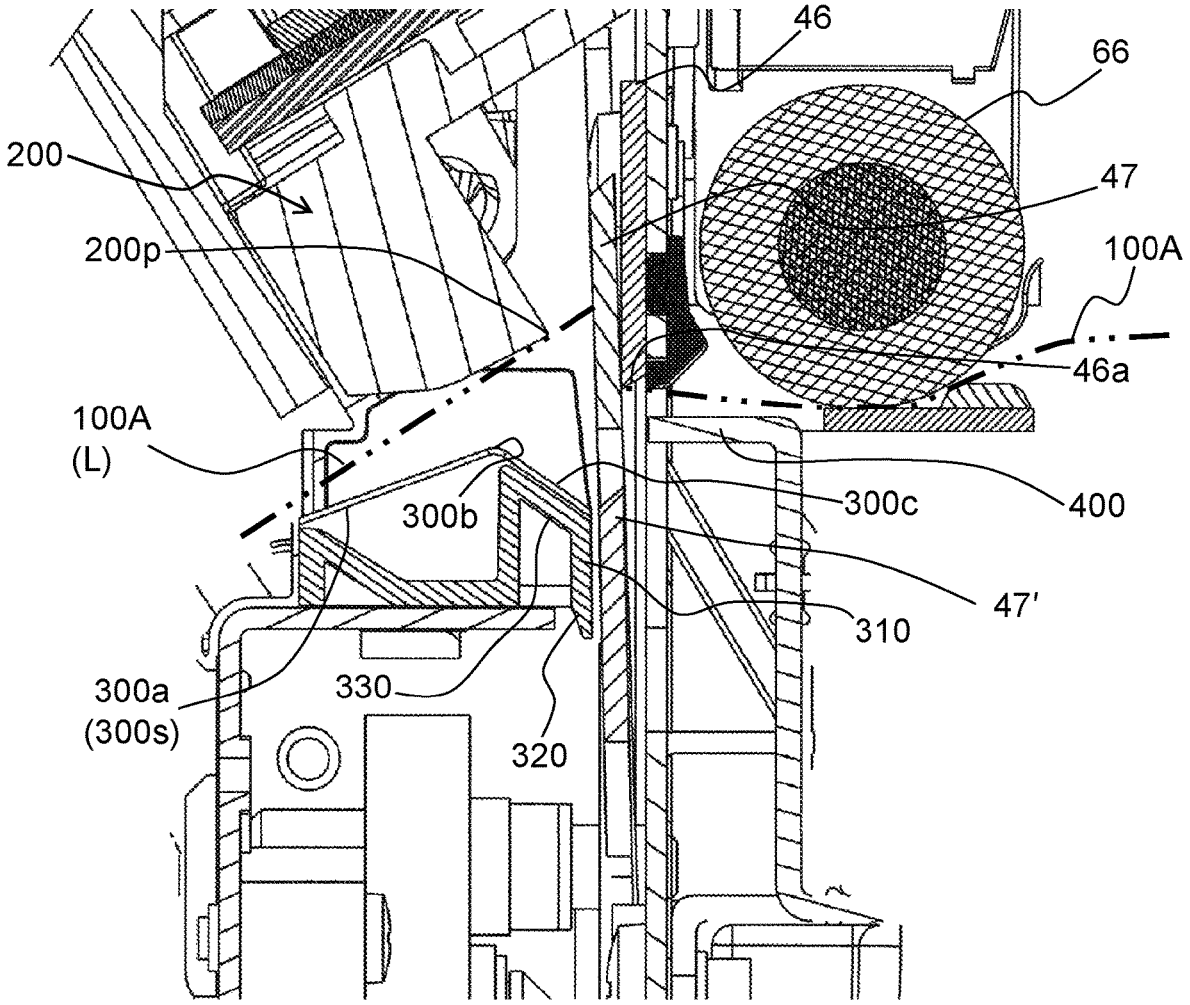
FIG. 20 is a schematic view showing a behavior of a print label after cutting of the print-receiving tape associated with ascent of the movable blade in the embodiment of the present disclosure.

Subsequently, as schematically shown in FIG. 20, as the movable blade 47 further ascends, the print label L comes into point contact (or line contact) from below with a contact part 200*p* composed of a corner portion on the rear side (in other words, the upstream side in the transport direction) of a lower end surface of the rear wall part 201 of the upper guide part 200.

Figure 21:
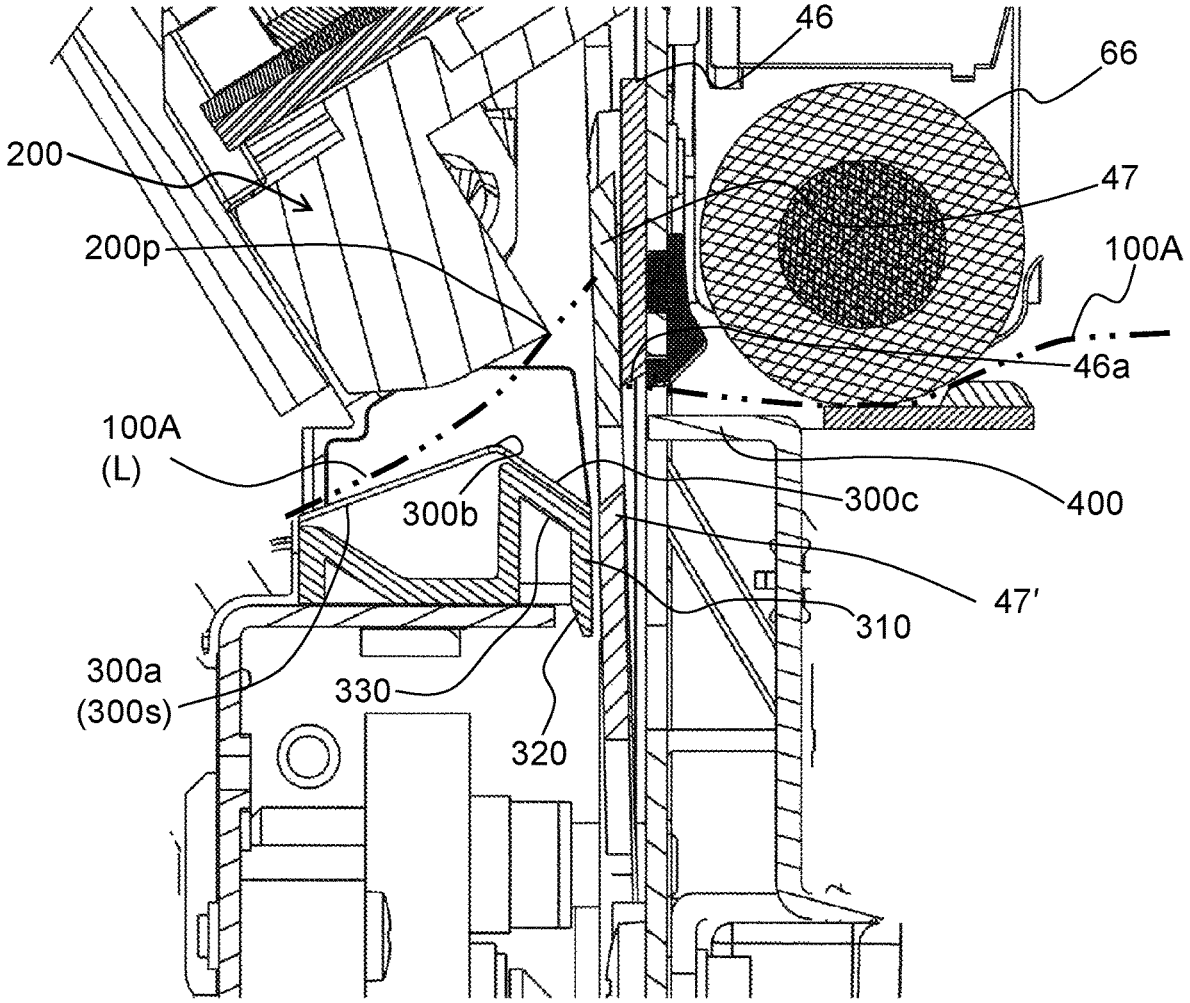
FIG. 21 is a schematic view showing a behavior of a print label after cutting of the print-receiving tape associated with ascent of the movable blade in the embodiment of the present disclosure.

Subsequently, when a portion in contact with the contact part 200*p* is restrained from further moving upward due to the contact part 200*p* as the movable blade 47 further ascends, the print label L elastically deforms such that the end portion on the cut side (the upstream side in the transport direction) gradually bends upward as schematically shown in FIG. 21.

Figure 22:
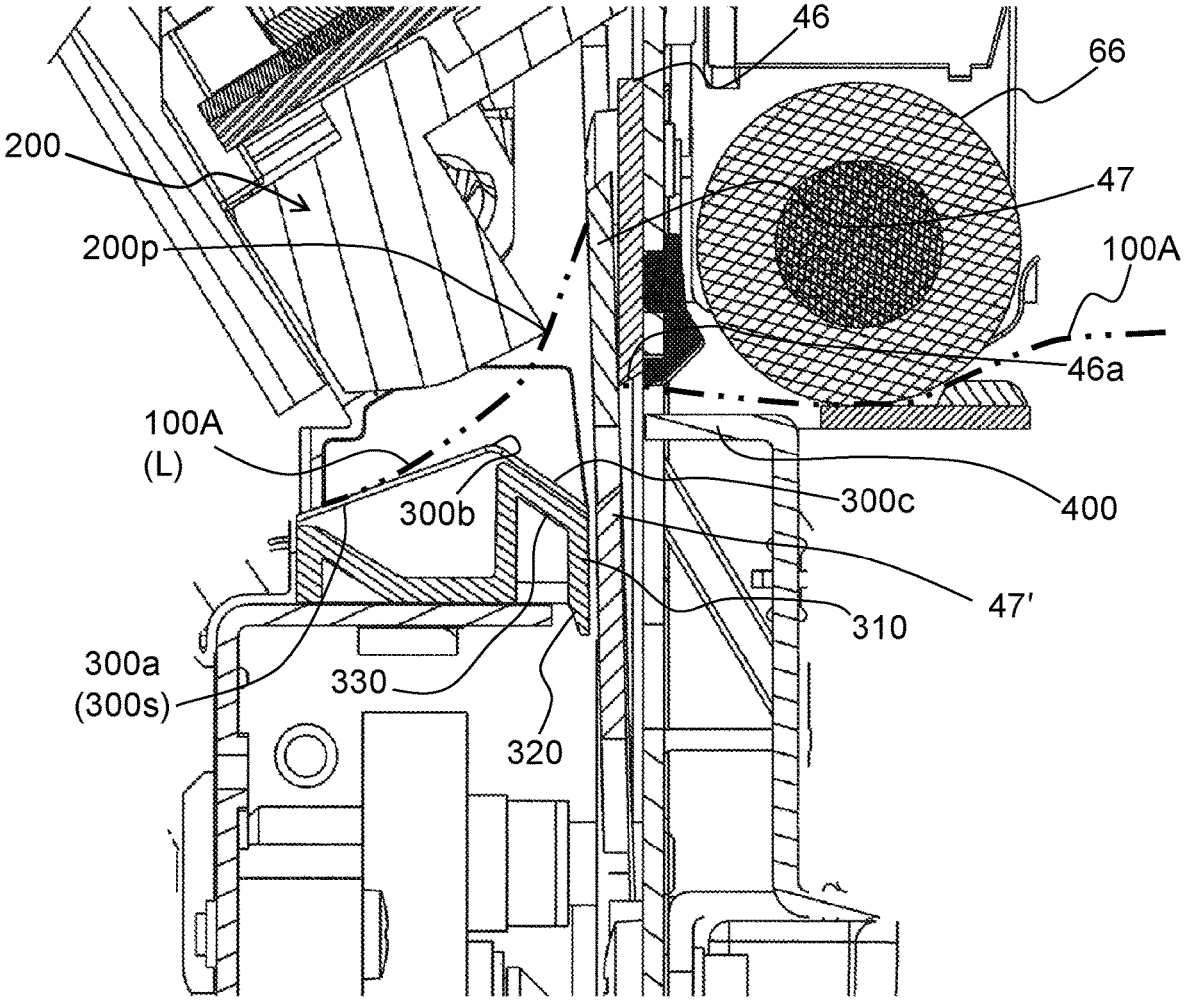
FIG. 22 is a schematic view showing a behavior of a print label after cutting of the print-receiving tape associated with ascent of the movable blade in the embodiment of the present disclosure.

Subsequently, as the movable blade 47 further ascends, as shown in FIG. 22, a portion of the print label L on the front side (in other words, the downstream side in the transport direction) comes into contact from above with a guide surface 300*s* including surfaces comprising respective upper slopes of the multiple partition walls 300*a* of the lower guide part 300, and a portion in contact therewith is restrained from further moving downward. As a result, subsequently, an amount of elastic deformation in the upwardly-bending form significantly increases in the print label L as the cutting progresses.

Figure 23:
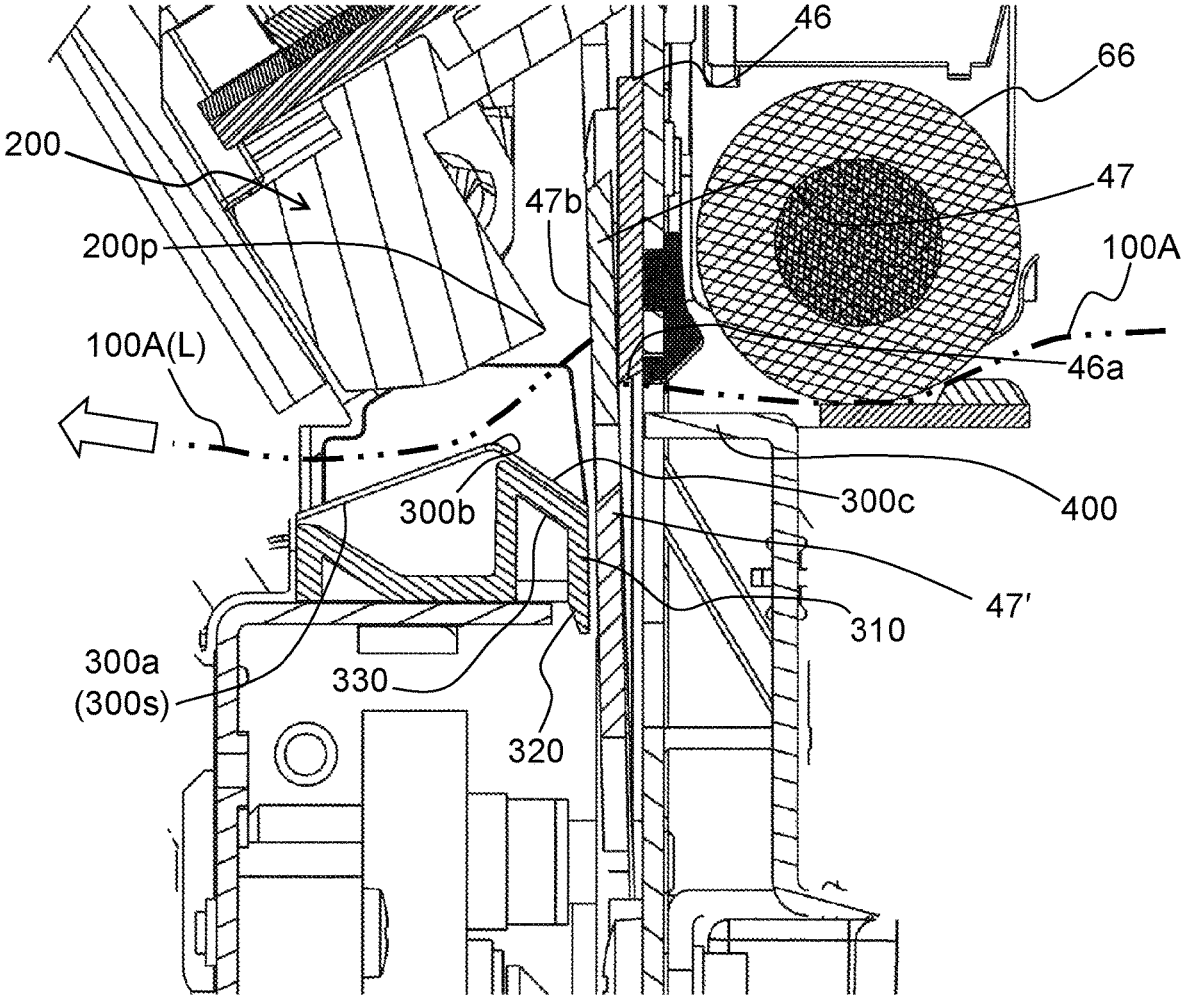
FIG. 23 is a schematic view showing a behavior of a print label after cutting of the print-receiving tape associated with ascent of the movable blade in the embodiment of the present disclosure.

As the movable blade 47 further ascends, when the print label L is completely cut, and the elastic deformation rapidly returns to the original state, as schematically shown in FIG. 23, the end portion of the cut print label L on the cut side (i.e., the upstream side in the transport direction) presses the side surface 47*b* of the movable blade 47 on the front side (in other words, the downstream side in the transport direction), and the cut print label L is discharged due to the reaction force in a pop-out manner from the discharging exit 6A (see white arrow). Although the position of the movable blade 47 gradually ascends in the state described above; however, in FIGS. 19 to 23, the position of the movable blade 47 is shown at the same position as that of FIG. 12, FIG. 13, etc. for simplification of illustration and clarification of the behavior of the print label L.

Figure 24:
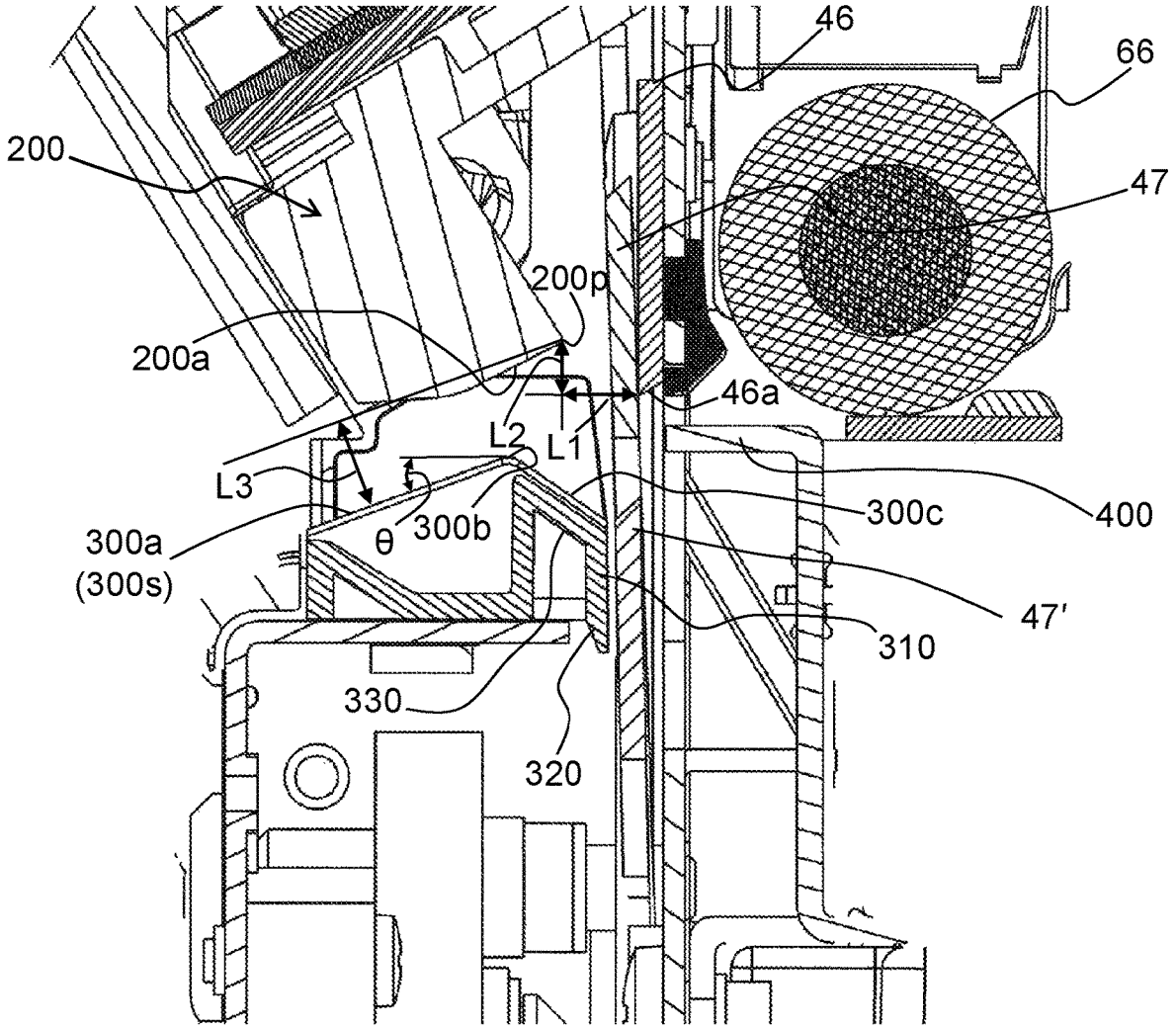
FIG. 24 is a side sectional view of a main portion extracted from FIG. 13, showing a dimensional relationship of portions of the upper guide part, the movable blade, and the lower guide part.

The present inventors found out that, as shown in FIG. 24, the cutting and discharging behavior of the print label L is significantly affected by values of a distance L1 along the transport direction and a distance L2 in the up-down direction between the blade edge 46*a* of the fixed blade 46 and the contact part 200*p* for the upper guide part 200 as well as values of a downward inclination angle θ of the guide surface 300*s* toward the downstream side in the transport direction and a distance L3 between the guide surface 300*s* and the contact part 200*p* in the direction orthogonal to the inclination direction for the lower guide part 300.

FIG. 25 shows results of study on discharge performance of the print label L based on the findings of the present inventor. FIG. 25 is a table showing quality of discharge performance of the print label L from the discharging exit 6A in the case that the L3 is changed from 2 [mm] to 8 [mm] while the inclination angle θ is changed from 15° to 45° under the condition that the L1 is 3 [mm] or more and 4 [mm] or less while L2 is 2 [mm] or more and 3 [mm] or less. In the figure, a circle represents that the print label L was favorably dischargeable from the discharging exit 6A, and a cross in the figure represents that the print label L was not dischargeable from the discharging exit 6A (it is noted that a condition of preventing accidental entry of a user's fingertip from the discharging exit 6A is included in some cases. the detailed explanation will not be made in the following description). A triangle in the figure represents that both the case of favorable discharge of the print label L from the discharging exit 6A and the non-dischargeable case were mixed.

As shown in FIG. 25, in the case of the inclination angle θ=5[°], the print label L was not dischargeable from the discharging exit 6A in any case at the L3=2 [mm], 3 [mm], 4 [mm], 5 [mm], 6 [mm], 7 [mm], and 8 [mm].

In the case of the inclination angle θ=15[°], the print label L was not dischargeable from the discharging exit 6A in the case of the L3=2 [mm], 7 [mm], and 8 [mm]; however, the print label L was favorably dischargeable from the discharging exit 6A in the case of the L3=4 [mm] and 5 [mm]. In the case of the L3=3 [mm] and 6 [mm], both the case of favorable discharge of the print label L from the discharging exit 6A and the non-dischargeable case were mixed.

In the case of the inclination angle θ=25[°], the print label L was not dischargeable from the discharging exit 6A in the case of the L3=2 [mm], 7 [mm], and 8 [mm]; however, the print label L was favorably dischargeable from the discharging exit 6A in the case of the L3=3 [mm], 4 [mm], 5 [mm], and 6 [mm].

In the case of the inclination angle θ=35[°], the print label L was not dischargeable from the discharging exit 6A in the case of the L 3=2 mm, 3 mm, 7 mm, and 8 mm; however, the print label L was favorably dischargeable from the discharging exit 6A in the case of the L3=4 [mm], 5 [mm], and 6 [mm].

In the case of the inclination angle θ=45[°], the print label L was not dischargeable from the discharging exit 6A in any case at the L3=2 [mm], 3 [mm], 4 [mm], 5 [mm], 6 [mm], 7 [mm], and 8 [mm].

From the results shown in FIG. 25, it was found that, from the viewpoint of discharging the print label L from the discharging exit 6 A, 3 [mm]≤L1≤4 [mm],
2 [mm]≤L2≤3 [mm],
15[°]≤θ≤35[°], and
3 [mm]≤L3≤6 [mm] are more preferable.

Advantages of Embodiment

As described above, in this embodiment, the scraping-off mechanism is disposed in proximity to the movable blade 47 separately from the movable blade 47 and the fixed blade 46. As a result, the adhesive having adhered to the movable blade 47 is brought into contact therewith and scraped off when the movable blade 47 moves from the lower side to the upper side. Consequently, the adhesive adhering to the movable blade 47 can be reduced by a simple and inexpensive configuration without disposing multiple tapered through-holes in the fixed blade and the movable blade as in the conventional case.

Particularly in this embodiment, the substantially flat plate-like extension part 310 is disposed on the front side of the movable blade 47 to face the movable blade 47, and the slope part 320 is formed on the lower end portion of the extension part 310 and is inclined toward the movable blade 47 while extending to the lower side. As a result, when the movable blade 47 moves from the lower side to the upper side as described above, the adhesive having adhered to the movable blade 47 can be scooped by the extension part 310 and the slope part 320 to scrape off more adhesive.

Particularly in this embodiment, the movable blade 47 is substantially V-shaped when viewed from the front or the rear, and the extension part 310 has a rectangular shape elongated in the left-right direction orthogonal to the sliding direction when viewed from the front or the rear. Therefore, while the movable blade 47 is substantially V-shaped, the extension part 310 has a rectangular shape, which is a different shape. This results in a form of sequentially scraping off the adhesive having adhered to the movable blade 47 along the V shape, rather than scraping off the adhesive having adhered to the movable blade 47 at one time, when the extension part 310 scrapes off the adhesive having adhered to the movable blade 47. Consequently, the weight (load) acting on the extension part 310 can be prevented from being excessively increased during scraping off.

Particularly in this embodiment, when the movable blade 47 is at the standby position in the case of the configuration in which the extension part 310 has a substantially inverted-triangular shape in the front view, the lower end portion of the extension part 310 is located at a position lower than the upper end portion (i.e., the blade edge 47*a*) of the movable blade 47. This has the following technical significance.

Figure 14E:
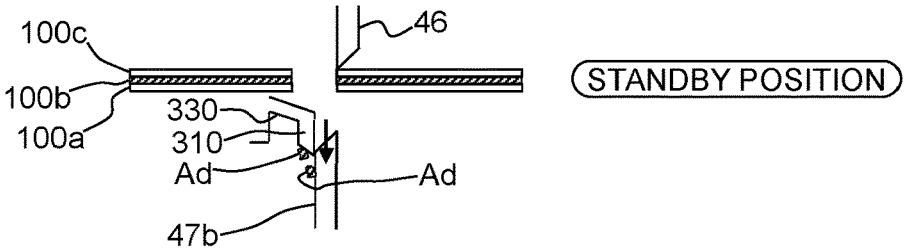
FIG. 14E is an explanatory view showing the print-receiving tape cutting behavior and the adhesive scraping-off/accumulating behavior in the embodiment of the present disclosure.
Figure 14F:
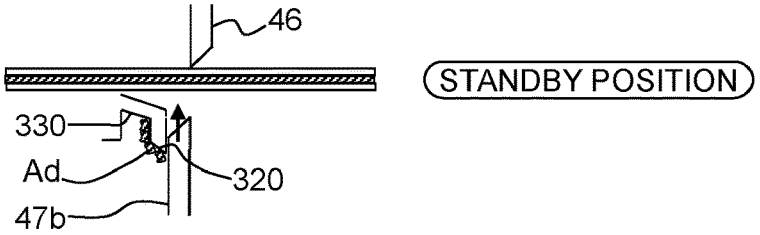
FIG. 14F is an explanatory view showing the print-receiving tape cutting behavior and the adhesive scraping-off/accumulating behavior in the embodiment of the present disclosure.
Figure 15A:
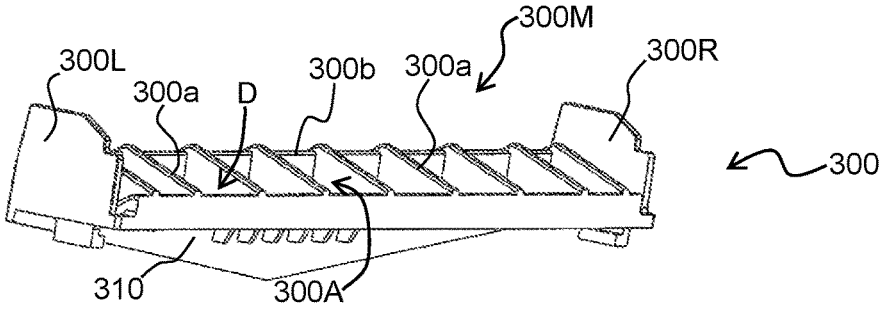
FIG. 15A is a perspective view from the front left showing a detailed structure of the lower guide part in an example in which a substantially inverted-triangular extension part is disposed.
Figure 15B:
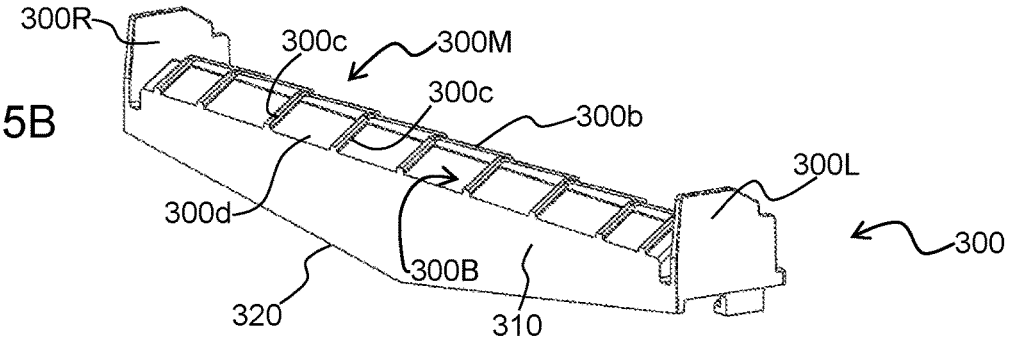
FIG. 15B is a perspective view from the rear left showing the detailed structure of the lower guide part in the example in which the substantially inverted-triangular extension part is disposed.
Figure 15C:
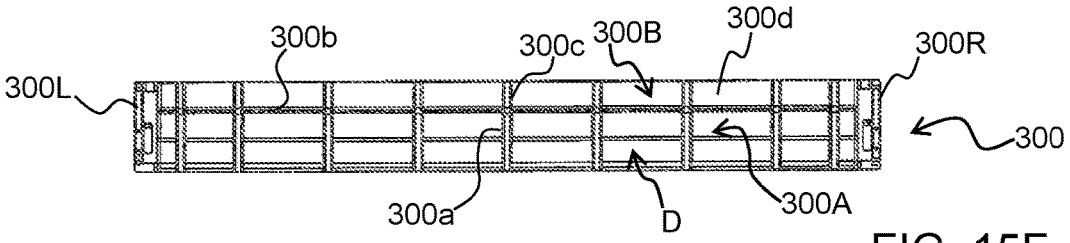
FIG. 15C is a top view showing the detailed structure of the lower guide part in the example in which the substantially inverted-triangular extension part is disposed.
Figure 15E:
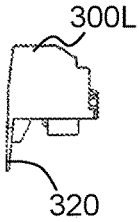
FIG. 15E is a left side view showing the detailed structure of the lower guide part in the example in which the substantially inverted-triangular extension part is disposed.
Figure 15D:
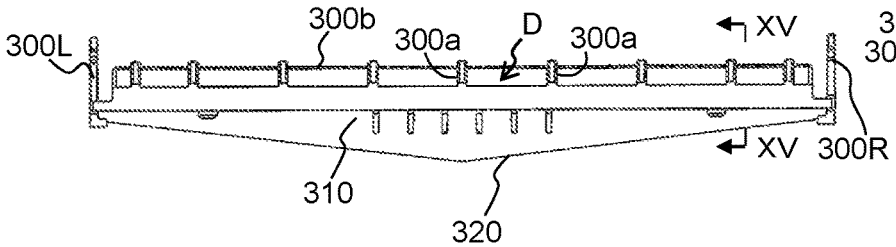
FIG. 15D is a front view from the front showing the detailed structure of the lower guide part in the example in which the substantially inverted-triangular extension part is disposed.
Figure 15F:
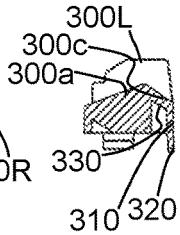
FIG. 15F is a side sectional view taken along a line XV-XV of FIG. 15D.
Figure 15G:
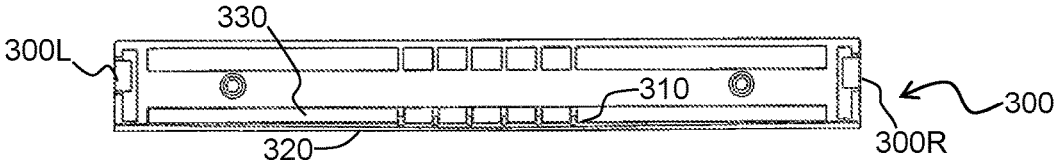
FIG. 15G is a rear view from below showing the detailed structure of the lower guide in the example in which the substantially inverted-triangular extension part is disposed.
Figure 16A:
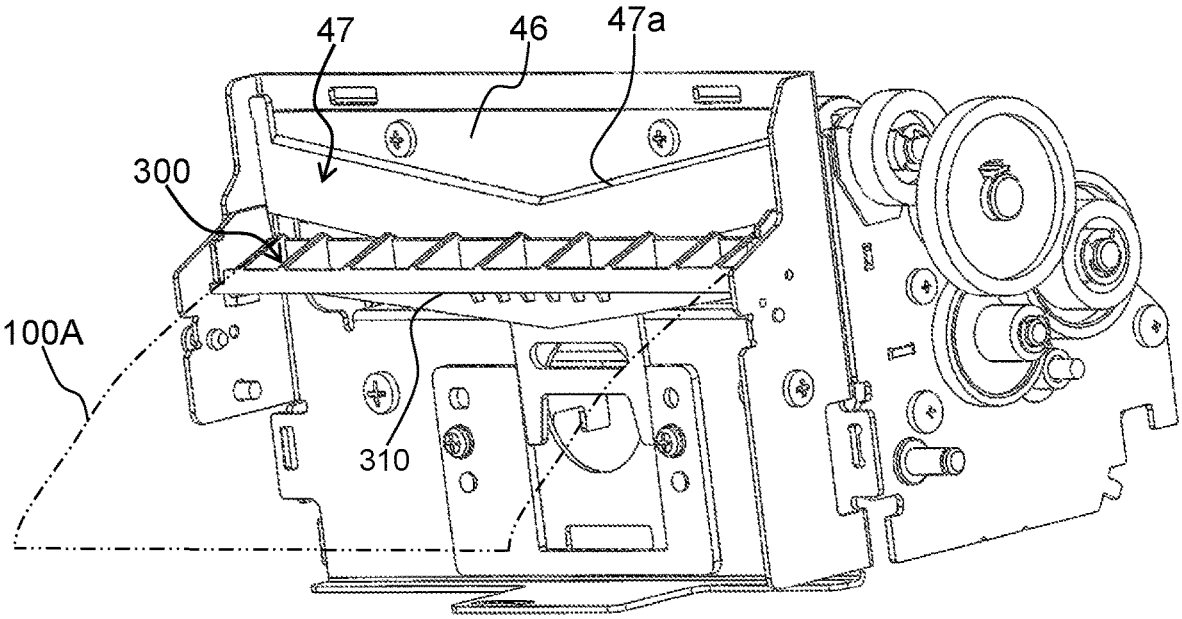
FIG. 16A is a perspective view from the front right showing a state in which the movable blade is at the cutting position among the fixed blade, the movable blade, the upper guide part, and the peripheral structure thereof in the example in which the extension part shown in FIGS. 15A to 15G is disposed.
Figure 16B:
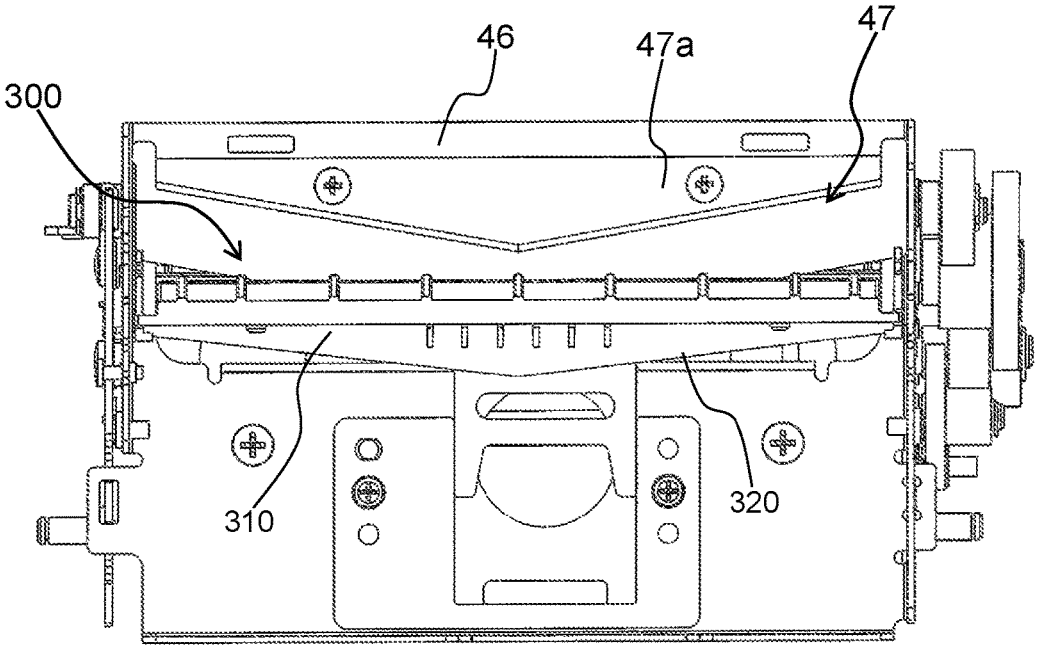
FIG. 16B is a front view from the front showing a state in which the movable blade is at the cutting position among the fixed blade, the movable blade, the upper guide part, and the peripheral structure thereof in the example in which the extension part shown in FIGS. 15A to 15G is disposed.

The adhesive scraped off from the movable blade 47 as described above stays at the lower end portion of the extension part 310 (see FIG. 14E). In this case, if the blade edge 47*a* of the movable blade 47 at the standby position is located at substantially the same position (substantially the same height) as the lower end portion of the extension part 310, the adhesive staying at the lower end portion of the extension part 310 may reattach to the blade edge 47*a* of the movable blade 47.

In this embodiment, since the lower end portion of the extension portion 310 is located at a position lower than the upper end portion of the movable blade 47, the adhesive staying at the lower end portion of the extension portion 310 does not reattach to the blade edge 47*a* of the movable blade 47. Consequently, contamination of the blade edge 47*a* of the movable blade 47 can be prevented, so that the cutting performance of the movable blade 47 can favorably be maintained.

Particularly in this embodiment, the accumulating part 330 introducing and accumulating the scraped adhesive is disposed. Therefore, the accumulating part 330 can sequentially introduce and accumulate the adhesive scraped off from the movable blade 47, so that even in the case that the cutting operation is performed a number of times and the adhesive has adhered to the movable blade 47 each time, the remaining adhesive having adhered to the movable blade 47 can be reduced.

Particularly in this embodiment, the extension portion 310 and the slope part 320 are disposed for scraping off the adhesive on the front side of the movable blade 47 (in other words, on the side of the movable blade 47 opposite to a surface rubbed with the fixed blade 46) as described above, along with the scraping-off plate 400 for scraping off the adhesive on the rear side of the fixed blade 46 (in other words, on the side of the fixed blade 46 opposite to a surface rubbed with the movable blade 47). Therefore, the adhesive having adhered to both sides of the movable blade 47 can be scraped off by both the parts and the plate.

Particularly in this embodiment, the lower guide part 300 including the extension part 310 and the slope part 320 as well as the scraping-off plate 400 all have the function as a guide part guiding the feeding of the print-receiving tape 100A. As a result, the structure can be miniaturized as compared to the case that the guide part is separately disposed.

In this embodiment, the upper guide part 200 has the contact part 200*p* disposed in a position separated from the blade edge 46*a* of the fixed blade 46 by L1 in the transport direction and by L2 in the upper direction, and the lower guide part 300 has the guide surface 300*s* inclined downward by θ toward the downstream side in the transport direction and disposed at a distance of L3 from the contact part 200*p* in the direction perpendicular to the inclined direction.

As a result, as described above with reference to FIGS. 19 to 23, when the end portion on the cut side of the print label L during cutting is deformed to bend upward as the movable blade 47 moves upward, the contact part 200*p* comes into point contact or line contact with the upper surface of the print label L, and the lower surface of the print label L to be cut comes into contact with the guide surface 300*s* as the movable blade 47 moves upward. As described above, when the print label L is completely cut, and the elastic deformation rapidly returns to the original state, the rear end portion of the cut print label L presses the side surface 47*b* of the movable blade 47 (see FIG. 23), and the cut print label L is discharged due to the reaction force in a pop-out manner from the discharging exit 6A. As a result, according to this embodiment, the cut print label L can reliably be discharged from the discharging exit 6A without staying in the upper guide part 200, the lower guide part 300, or the discharging exit 6A.

Particularly in this embodiment, on the basis of the results of study on discharge performance of the print label L described above shown in FIG. 25A, the ranges are set, in terms of the distance L1 along the transport direction and the distance L2 in the up-down direction between the blade edge 46*a* of the fixed blade 46 and the contact part 200*p* for the upper guide part 200 as well as the downward inclination angle θ of the guide surface 300*s* toward the downstream side in the transport direction and the distance L3 between the guide surface 300*s* and the contact part 200*p* in the direction orthogonal to the inclination direction for the lower guide part 300, to 3 [mm]≤L1≤4 [mm], 2 [mm]≤L2≤3 [mm], 15[°]≤θ≤35[°], and 3 [mm]≤L3≤6 [mm] (particularly preferably 4 [mm]≤L3≤5 [mm]), respectively. As a result, the print-receiving tape 100A can reliably be discharged from the discharging exit 6A due to the reaction force.

Figure 3:
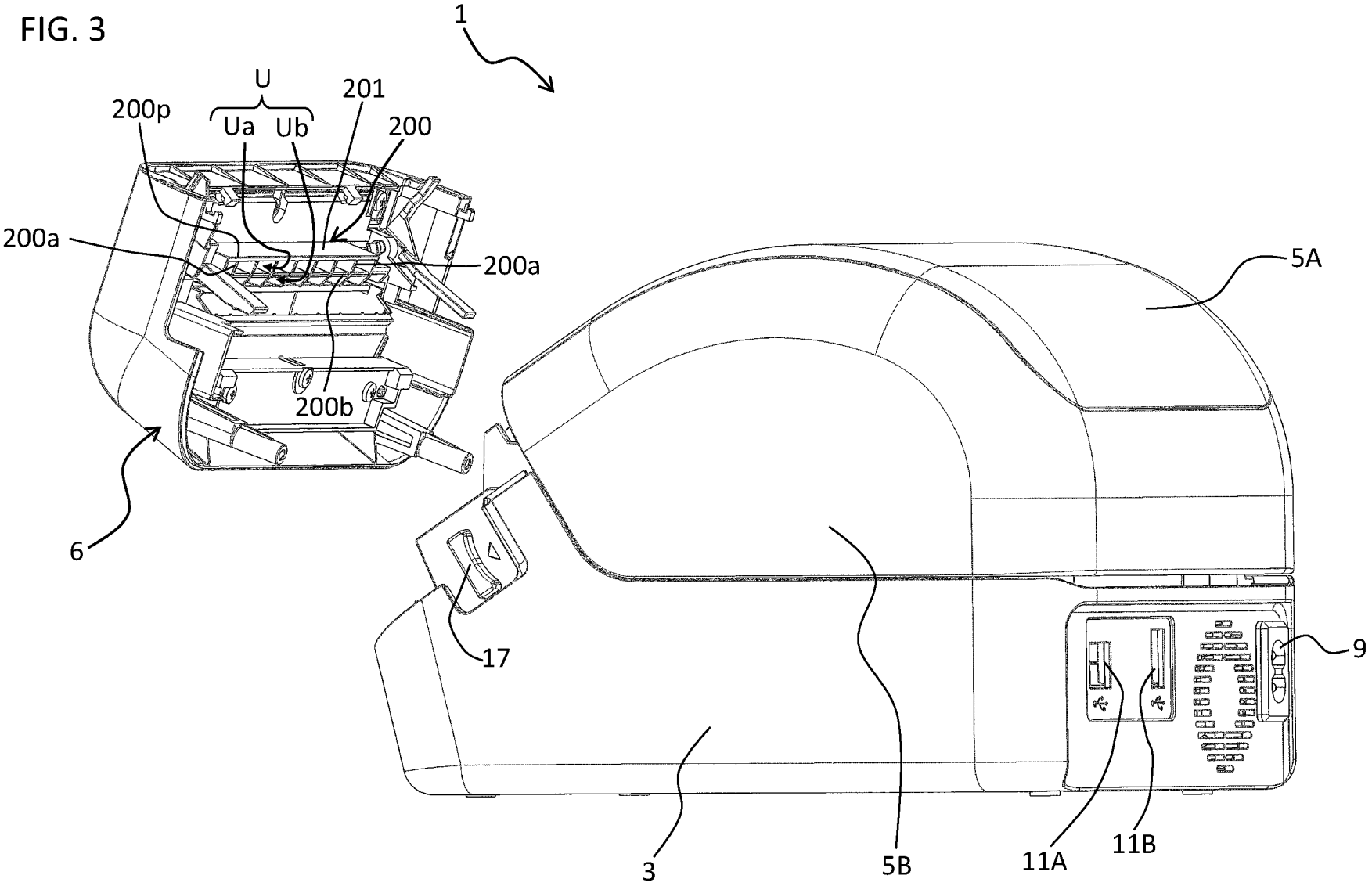
FIG. 3 is an exploded perspective view showing a state with the front panel removed as viewed from the rear right.

Particularly in this embodiment, the contact part 200*p* includes the corner portion on the rear side of the lower end surface of the rear wall part 201 of the upper guide part 200 that is a substantially rectangular parallelepiped box body partitioned by the multiple partition walls 200*a* (see FIGS. 3, 24, etc.). As a result, when the rear end portion of the print label L is deformed into a bending form as described above (see FIGS. 20, 21, 22), the configuration of point contact (or line contact) with the upper surface of the print label L can reliably be implemented.

Figure 5F:
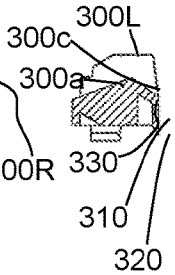
FIG. 5F. is a side sectional view taken along a line V-V of FIG. 5D.
Figure 5G:
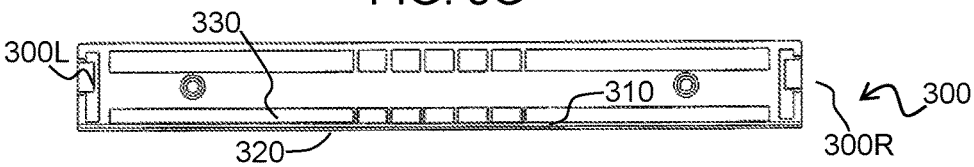
FIG. 5G is a bottom view from below showing the detailed structure of the lower guide part.

Particularly in this embodiment, the guide surface 300*s* of the lower guide part 300 includes surfaces comprising the upper slopes of the partition walls 300*a* of the front region 300A that is a substantially rectangular parallelepiped box body partitioned by the multiple partition walls 300*a* (see FIGS. 5A, 5F, 24, etc.). This enables reliable implementation of the configuration causing the contact of the lower surface of the print label L to be cut as the movable blade 47 moves upward (see FIG. 22).

Particularly in this embodiment, the print-receiving tape 100A printed and fed through cooperation between the platen roller 66 and the printing head 61 can be cut by the cutter unit 8 to produce the print label L in the label producing apparatus 1.

It is noted that terms "vertical", "parallel", "plane", etc. in the above description are not used in the exact meanings thereof. Specifically, these terms "vertical", "parallel", "plane", etc. allow tolerances and errors in design and manufacturing and have meanings of "substantially vertical", "substantially parallel", and "substantially plane", etc.

It is noted that terms "same", "equal", "different", etc. in relation to a dimension and a size of the appearance in the above description are not used in the exact meaning thereof. Specifically, these terms "same", "equal", and "different" allow tolerances and errors in design and manufacturing and have meanings of "substantially the same", "substantially equal", and "substantially different".

The techniques of the embodiment and modification examples may appropriately be utilized in combination other than those described above.

What is claimed is:

1. A cutting apparatus comprising:

a feeder configured to feed a print-receiving medium including an adhesive layer along a predetermined transport direction;

a fixed blade having a shape like a flat plate;

a movable blade that has a shape like a flat plate and is configured to slide in a sliding direction crossing said transport direction against said fixed blade and is configured to move along the sliding direction from a standby position on one side to a cutting position on the other side and to cut said print-receiving medium fed by said feeder; and at least one scraping-off device that is disposed in proximity to said movable blade and is configured to come into contact from the other side with an adhesive that has adhered to said movable blade and scrape off said adhesive when said movable blade moves from the standby position on the one side to the cutting position on the other side.

2. The cutting apparatus according to claim 1, wherein said at least one scraping-off device comprises an extension part that has a shape substantially like a flat plate and is disposed downstream from said movable blade in said transport direction to face said movable blade, and wherein said extension part includes a slope part that is formed on an end portion on the one side and is inclined in a manner that the more a portion of the slope part is positioned in the one side, the more the portion of the slope part comes closer to said movable blade.

3. The cutting apparatus according to claim 2, wherein said movable blade has a substantially V-like shape in a view from said transport direction, and wherein said extension part has a rectangular shape elongated in an orthogonal direction orthogonal to said sliding direction in the view from said transport direction.

4. The cutting apparatus according to claim 2, wherein when said movable blade is at said standby position, the end portion of said extension part on the one side is located at a position lower than an end portion of said movable blade on the other side.

5. The cutting apparatus according to claim 2, further comprising an accumulating part that is disposed downstream from said extension part in said transport direction and is configured to introduce and accumulate the adhesive scraped off by said at least one scraping-off device.

6. The cutting apparatus according to claim 2, wherein said at least one scraping-off device includes:

a first scraping-off device disposed upstream from said movable blade in said transport direction; and a second scraping-off device disposed downstream from said movable blade in said transport direction, and wherein said extension part and said slope part are included in said second scraping-off device.

7. The cutting apparatus according to claim 1, wherein said at least one scraping-off device also serves as a guide part configured to guide a feeding of said print-receiving medium by said feeder.

8. A printer comprising:

a cutting apparatus; and a printing head, wherein said cutting apparatus comprises:

a feeder configured to feed a print-receiving medium including an adhesive layer along a predetermined transport direction;

a fixed blade having a shape like a flat plate;

a movable blade that has a shape like a flat plate and is configured to slide in a sliding direction crossing said transport direction against said fixed blade and is configured to move along the sliding direction from a standby position on one side to a cutting position on the other side and to cut said print-receiving medium fed by said feeder; and at least one scraping-off device that is disposed in proximity to said movable blade and is configured to come into contact from the other side with an adhesive that has adhered to said movable blade and scrape off said adhesive when said movable blade moves from the standby position on the one side to the cutting position on the other side, and wherein said printing head performs printing on said print-receiving medium fed by said feeder.

9. The printer according to claim 8, wherein said at least one scraping-off device of said cutting apparatus comprises an extension part that has a shape substantially like a flat plate and is disposed downstream from said movable blade in said transport direction to face said movable blade, and wherein said extension part includes a slope part that is formed on an end portion on the one side and is inclined in a manner that the more a portion of the slope part is positioned in the one side, the more the portion of the slope part comes closer to said movable blade.

10. The printer according to claim 9, wherein said movable blade of said cutting apparatus has a substantially V-like shape in a view from said transport direction, and wherein said extension part has a rectangular shape elongated in an orthogonal direction orthogonal to said sliding direction in the view from said transport direction.

11. The printer according to claim 9, wherein when said movable blade is at said standby position, the end portion of said extension part on the one side is located at a position lower than an end portion of said movable blade on the other side.

12. The printer according to claim 9, wherein said cutting apparatus further comprises an accumulating part that is disposed downstream from said extension part in said transport direction and is configured to introduce and accumulate the adhesive scraped off by said at least one scraping-off device.

13. The printer according to claim 9, wherein said at least one scraping-off device of said cutting apparatus includes:

a first scraping-off device disposed upstream from said movable blade in said transport direction; and a second scraping-off device is disposed downstream from said movable blade in said transport direction, and wherein said extension part and said slope part are included in said second scraping-off device.

14. The printer according to claim 8, wherein said at least one scraping-off device of said cutting apparatus also serves as a guide part configured to guide a feeding of said print-receiving medium by said feeder.

* * * * *